US007641081B2

(12) United States Patent
Kido et al.

(10) Patent No.: US 7,641,081 B2
(45) Date of Patent: Jan. 5, 2010

(54) IMMERSION NOZZLE

(75) Inventors: Koji Kido, Fukuoka (JP); Joji Kurisu, Fukuoka (JP); Arito Mizobe, Fukuoka (JP); Hiroshi Otsuka, Fukuoka (JP); Masahide Yoshida, Fukuoka (JP)

(73) Assignee: Krosakiharima Corporation, Fukuoka (JP)

( * ) Notice: Subject to any disclaimer, the term of this patent is extended or adjusted under 35 U.S.C. 154(b) by 0 days.

(21) Appl. No.: 12/001,134

(22) Filed: Dec. 10, 2007

(65) Prior Publication Data

US 2009/0145934 A1 Jun. 11, 2009

(51) Int. Cl.
*B22D 41/08* (2006.01)

(52) U.S. Cl. ..... 222/606; 222/594; 164/337

(58) Field of Classification Search ..... 222/606, 222/594; 164/337, 437
See application file for complete search history.

(56) References Cited

U.S. PATENT DOCUMENTS 6,260,742 B1 * 7/2001 Caillaud et al. ..... 222/594
6,341,722 B1 * 1/2002 Tolve et al. ..... 222/606

FOREIGN PATENT DOCUMENTS

JP 63-085358 6/1988
JP 11010292 A * 1/1999
JP 2004-344900 12/2004

* cited by examiner

*Primary Examiner*—Scott Kastler
(74) *Attorney, Agent, or Firm*—Jordan and Hamburg LLP

(57) ABSTRACT

Disclosed is an immersion nozzle, which comprises a vertically-extending pipe-shaped straight nozzle body 10 adapted to allow molten steel to pass downwardly from an inlet port 9 provided at an upper end thereof, and a pair of discharge portions each including a respective one of a pair of outlet ports 12 provided in a lower portion of the straight nozzle body 10 in a bilaterally symmetrical arrangement and adapted to discharge molten steel laterally from a lateral side of the straight nozzle body. Each of the discharge portions has an inner surface defining the outlet port 12 and extending parallel to an axis of the outlet port 12 to define a length of the discharge portion at 45 mm or more. A ratio of S1/S2 is in the range of 0.8 to 1.8, wherein S1 is a total transverse vertical cross-sectional area of the outlet ports, and S2 is a cross-sectional area of an inner hole of the straight nozzle body taken along a plane including a line connecting respective inwardmost and uppermost positions of the outlet ports and extends perpendicularly to an axis of the straight nozzle body. The axis of the outlet port extends laterally outwardly and downwardly at the following angle θt with respect to a horizontal direction: $0° \leqq \theta t \leqq 20°$. The immersion nozzle of the present invention can suppress deceleration of a molten steel flow discharged from the outlet port to obtain a flow speed in an intended direction over a maximized distance.

3 Claims, 17 Drawing Sheets

IMMERSION NOZZLE

BACKGROUND OF THE INVENTION

1. Field of the Invention

The present invention relates to an immersion nozzle, and more particularly to an immersion nozzle for pouring molten steel into a mold during a continuous casting process, wherein the mold has a mold cavity formed with a substantially rectangular-shaped horizontal cross-section having a long side of 2000 mm or more and a short side of 150 mm or less.

2. Description of the Related Art

Heretofore, in a mold for receiving therein molten steel to produce a steel plate, so-called "slab", during a continuous casting process, a mold cavity has been generally designed to have a width dimension of less than about 2000 mm. Recently, there has emerged a high-speed casting operation using a mold having a wide mold cavity, i.e., a mold cavity with a larger width dimension, more specifically, a mold cavity formed with a substantially rectangular-shaped horizontal cross-section having a long side (i.e., width) of about 2000 mm or more and a short side (i.e., thickness) of about 150 mm or less.

In an operation of pouring molten steel into such a wide mold cavity, a molten steel flow discharged from an outlet port of an immersion nozzle (i.e., submerged nozzle) will be spread and decelerated in a vicinity of a lateral end of the mold cavity, and further deflected downwardly below the outlet port due to extraction of a slab from the mold. Thus, a stagnant region having poor fluidity is liable to occur in an upper region of the lateral end of the mold cavity. Moreover, a molten steel flow in the mold cavity is apt to become unstable due to episodic occurrence of turbulences therein, such as reversed flows in various regions of the mold cavity and locally deflected flows which frequently change with time, and resulting fluctuation ("wave", "heave", "change in flow direction") in a molten steel surface, to cause difficulty in allowing inclusions around a lateral end of a slab to sufficiently float up and in allowing a mold powder to be uniformly transferred onto a surface of the slab, which leads to uneven incorporation of the mold powder and the inclusions into the slab. The unstable molten steel flow causes another problem about difficulty in obtaining a temperature distribution of molten steel in the mold cavity requited for or optimal to formation of a shell (i.e., primary solidification shell) of a slab during a course of solidification the molten steel. This exerts a negative impact on quality of a slab and increases the risk of break (e.g., cracks) of a slab.

In order to solve the above problems, it is necessary to stably form and maintain a molten steel flow, such as an upward flow in the lateral end of the mold cavity, and a flow directed toward a center of the mold cavity along a vicinity of a molten steel surface in the entire mold cavity, i.e., a reversed flow, while minimizing deceleration of the molten steel flow, even in the lateral end of the mold cavity. From a practical standpoint, even if only dimensions of an immersion nozzle, such as an axial direction and a cross-sectional area of an outlet port thereof, are simply adjusted while maintaining its conventional structure, it is unable to suppress the large spreading and deceleration of the molten steel flow and obtain the above required molten steel flow.

Specifically, as measures for solving the above problems, it has been tried to allow a molten steel flow discharged from an outlet port of an immersion nozzle to have fluidity required in the vicinity of the molten steel surface, even in the vicinity of the lateral end of the mold cavity, for example, by setting an axial direction of the outlet port of the immersion nozzle in an upward direction relative to a horizontal direction. In this immersion nozzle, the outlet port is formed in a part of a wall of a straight nozzle body thereof. Thus, even if the axial direction of the outlet port is variously adjusted under a constraint of a predetermined wall thickness of the straight nozzle body, it is unable to ensure sufficient fluidity in the lateral end of the wide mold cavity.

There has been known an immersion nozzle comprising a straight nozzle body, an outlet port portion protruding in a lateral direction slightly beyond a wall thickness of the straight nozzle body to serve as a means for controlling a molten steel flow, and a grid- or bar-shaped CaO-containing member primarily made of CaO and attached inside the outlet port portion, as disclosed, for example, in JU 63-085353A (Patent Publication 1). Although this immersion nozzle is designed to elongate the outlet port portion in the lateral direction so that a molten steel flow discharged from an outlet port in the outlet port portion can be directed in a desired direction, the molten steel flow is slowed due to the configuration of the outlet port bent at certain angle and the grid- or bar-shaped CaO-containing member disposed in the outlet port (it is rather intended to positively decelerate the molten steel flow). Thus, the immersion nozzle disclosed in Patent Publication 1 is incapable of allowing a molten steel flow required in the vicinity of the molten steel surface to be stably formed in a desirable range including the lateral end of the wide mold cavity.

JP 2004-344900A (Patent Publication 2) discloses an immersion nozzle comprising a canopy (or hood)-like member disposed above and/or below an outlet port thereof. Although this immersion nozzle provided with the canopy-like member can suppress formation of a downward flow, a molten steel flow is inevitably slowed and spread/decelerated particularly in a region having no canopy-like member. Thus, the immersion nozzle disclosed in Patent Publication 2 is incapable of allowing a molten steel flow required in the vicinity of the molten steel surface to be stably formed in a desirable range including the lateral end of the wide mold cavity.

All the above conventional approaches for controlling a molten steel flow based on the configuration of an outlet port of an immersion nozzle are not intended for the wide mold cavity, and a basic concept thereof is to positively slow or decelerate a molten steel flow in the mold cavity. That is, means for allowing a molten steel flow required in the vicinity of the molten steel surface to be stably formed in a desirable range including the lateral end of the wide mold cavity has not been yet disclosed.

SUMMARY OF THE INVENTION

In view of the above circumstances, it is an object of the present invention to provide an immersion nozzle capable of suppressing deceleration of a molten steel flow discharged from each of a pair of outlet ports thereof and linearly obtaining a flow speed in an intended direction over a maximized distance. In particular, it is an object of the present invention to provide an immersion nozzle capable of allowing an intended molten steel flow to be linearly formed in a desirable range including a lateral end of a wide mold cavity formed with a substantially rectangular-shaped horizontal cross-section having a long side of 2000 mm or more and a short side of 150 mm or less, while stably forming an upward flow in a vicinity of the lateral end of the mold cavity and a molten steel flow required in a vicinity of a molten steel surface in the entire mold cavity.

It is another object of the present invention to provide stable and enhanced quality in slabs and enhanced safety in a continuous casting process.

As used in this specification, the term "intended direction" means a direction of a molten steel flow discharged from each of a pair of outlet ports of an immersion nozzle, wherein the direction of the molten steel flow can be set under a majority of operational conditions during an operation of pouring molten steel into a mold having a mold cavity formed with a substantially rectangular-shaped horizontal cross-section having a long side of 2000 mm or more and a short side of 150 mm or less, at a throughput range of 1.8 to 4.5 tons/min. An optimal direction of a molten steel flow varies depending individual operational conditions in steel manufacturers, such as specifications and operating conditions of individual continuous casting facilities/machines, with/without electromagnetic stirring, and a direction and a level of the electromagnetic stirring. That is, the "intended direction" is a parameter to be finely adjusted in design process, depending on such individual operational conditions. Therefore, in this specification, the term "intended direction" is not necessarily used on the assumption that it means a specific strictly-accurate direction of a molten steel flow.

Through various researches for solving the aforementioned problems in continuous casting, particularly in a continuous casting process where molten steel is poured into a mold having a mold cavity formed with a substantially rectangular-shaped horizontal cross-section having a long side of 2000 mm or more and a short side of 150 mm or less, the inventors of this application have found that it is important to linearly form a molten steel flow while minimizing spreading thereof, at a time when molten steel is discharged from each of a pair of outlet ports of an immersion nozzle disposed at an approximately center of the mold cavity.

The inventors have also found that such a linear molten steel flow capable of suppressing spreading can be obtained by providing, in an immersion nozzle, a pair of discharge portions each having an inner wall surface defining a respective one of the outlet ports, wherein the inner wall surface is formed to extend linearly, i.e., extend parallel to a longitudinal direction of an axis of the outlet port in such a manner as to define a length of a corresponding one of the discharge portions at a length of 45 mm or more.

In addition, the inventors have found that molten steel passing through the straight nozzle body in a vertically downward direction can be discharged from each of the outlet ports in an intended direction by setting a ratio of S1/S2 in the range of 0.8 to 1.8, wherein S1 is a total transverse vertical cross-sectional area of the outlet ports, and S2 is a cross-sectional area of an inner hole of the straight nozzle body taken along a plane which includes a line connecting respective uppermost positions of inwardmost edges of the outlet ports and extends in perpendicular relation to an axial direction of the straight nozzle body.

Furthermore, the inventors have found that a molten steel flow can be effectively formed linearly while minimizing spreading thereof, by allowing the axis of each of the outlet ports to extend laterally outwardly and downwardly at an angle θt falling within the following range with respect to a horizontal direction: $0° \leqq \theta t \leqq 20°$.

The inventors have verified that the above effects of the outlet ports formed in the above manner become most prominent when the immersion nozzle is used for pouring molten steel into a mold having a mold cavity formed with a substantially rectangular-shaped horizontal cross-section having a long side of 2000 mm or more and a short side of 150 mm or less, at a throughput range of 1.8 to 4.5 tons/min.

Specifically, the present invention provides an immersion nozzle which comprises a pipe-shaped straight nozzle body (see 10 in FIG. 2) which is formed to extend in a substantially vertical direction and have an inlet port (see 9 in FIG. 2) in an upper end thereof and adapted to allow molten steel to pass downwardly from the inlet port therethrough, and a pair of discharge portions each including a respective one of a pair of outlet ports (see 12 in FIG. 2) which are provided in a lower portion of the straight nozzle body bilaterally symmetrically with respect to the straight nozzle body, and adapted to discharge molten steel from a lateral side of the straight nozzle body therethrough in opposite lateral directions, wherein each of the outlet ports is defined by an inner wall surface formed in a corresponding one of the discharge portions. In this immersion nozzle, a first requirement is that the inner wall surface defining the outlet port in each of the discharge portions is formed to extend parallel to a longitudinal direction of an axis (see Dt in FIG. 3(*a*)) of the outlet port in such a manner as to define a length (see L1 in FIG. 3(*a*)) of the discharge portion at 45 mm or more.

As described in the first requirement, the inner wall surfaces defining the outlet portion in each of the discharge portions is formed to extend parallel to an axial direction of the outlet port. This means that a part of a refractory inner wall surface of the immersion nozzle (the inner wall surface having the length L1 in FIG. 3(*a*)) which defines a space of the outlet port is parallel to the longitudinal direction of the axis of the outlet port (see Dt in FIG. 3(*a*)), i.e., a center line of a vertical cross-section of the outlet port taken along a molten-steel discharge direction. That is, regardless of a shape of the vertical cross-section of the outlet port taken along the molten-steel discharge direction, the inner wall surface is formed as a 3-dimensional surface which is defined by an infinite number of lines each connecting a certain point of one peripheral edge of the outlet port on an inward side of the immersion nozzle and a certain point of the other peripheral edge of the outlet port on an outward side of the immersion nozzle, wherein the 3-dimensional surface has a cylindrical shape with a given transverse vertical cross-section, such as a circular cross-section or a polygonal cross-section, and extends in the axial direction of the outlet port without an angular difference with respect to the axial direction of the outlet port. Exceptionally, the inner wall surface may have a reverse taper angle of up to about 2° in consideration of the necessity thereof in a process of forming the outlet port.

In an initial stage of casing (i.e., an initial stage of pouring of molten steel into a mold), it is necessary to quickly supply molten steel into a mold. Thus, an immersion nozzle is typically designed to have dimensions, such as a cross-sectional area of an inner hole, enough to satisfy a required molten-steel supply rate, so that no local stagnation of molten steel occurs in the inner hole of the immersion nozzle in the initial stage of casting. However, in a subsequent steady operation stage, the molten-steel supply rate is reduced depending on a slab extraction rate (this operation will hereinafter referred to as "restricted pouring operation"), and thereby a local stagnation of molten steel occurs in the inner hole. Due to such imbalance between a molten-steel supply capacity and an actual molten-steel supply rate, a molten steel flow is discharged in a direction different from a preset axial direction (see Dt in FIG. 11(*a*)) of an outlet port, for example, in a direction (see Dm in FIG. 11(*a*)) oriented downwardly relative to the preset axial direction (i.e., with an angular difference Δθ as shown in FIG. 11(*a*)).

Particularly, in an operation of pouring molten steel into the wide mold cavity having a width (i.e., long side: see Mw in FIG. 1(*a*)) of about 2000 mm or more, with a view to ensuring a cross-sectional area of an inner hole of an immersion nozzle necessary for a desired molten-steel supply amount, an inner hole (see 11 in FIG. 2) in a straight nozzle body of the immersion nozzle is required to be formed in a flat shape, instead of a perfectly circular shape. Moreover, in a recent continuous casting operation, a thickness of a slab, i.e., a thickness (i.e., short side: see Mt in FIG. 1(*a*)) of a mold cavity, tends to be reduced down, for example, to about 150 mm or less, which accelerates flattening of the straight nozzle body (the inner hole). In conjunction with the above trend, an outlet port also tends to be formed in a vertically-long flat shape (see, for example, FIG. 3(*c*)). Such an immersion nozzle is liable to increase the risk of occurrence of spreading/deceleration of a molten steel flow in the mold cavity, and turbulences in the mold cavity, as compared with an immersion nozzle having a straight nozzle body (an inner hole) and an outlet port at least either one of which is formed with a perfect circular-shaped cross-section.

In the immersion nozzle of the present invention where the inner wall surface defining the outlet port in each of the discharge portions is formed to extend parallel to the longitudinal direction of the axis of the outlet port in such a manner as to define a length of the discharge portion at 45 mm or more, even if at least either one of the straight nozzle body (the inner hole) and the outlet port is formed with a flat-shaped cross-section, an angular difference between a preset axial direction of the outlet port and a discharge direction of a molten steel flow discharged from the outlet port during a restricted pouring operation can be substantially eliminated to obtain a stable upward flow and a stable reversed flow in a desired range including a lateral end of the mold cavity.

An optimal flow speed of the "stable upward flow" set forth above is not a value in a general/universal fixed specific range, but a value which varies (changes) depending on individual operational conditions. For example, from inventors' experience, the "stable upward flow" means a state when upward flows each having a flow speed of about 0.02 to 0.20 m/sec are stably obtained with time, in respective opposite lateral ends (see Fu in FIG. 1(*a*)) of the mold cavity in a bilaterally symmetrical manner.

Similarly, an optimal flow speed of the "stable reversed flow" set forth above is not a value in a general/universal fixed specific range, but a value which varies (changes) depending on individual operational conditions. For example, from inventors' experience, the "stable reversed flow" means a state when reversed flows each directed from each of the opposite lateral ends of the mold cavity toward the immersion nozzle (see Fr in FIG. 1(*a*)) at a flow speed of about 0.10 to 0.50 m/sec are stably obtained with time, at a depth of 30 mm from a molten steel surface in the mold cavity in a bilaterally symmetrical manner.

In contrast, in a conventional immersion nozzle (see FIGS. 9 and 10(*a*) to 10(*c*)) where each of a pair of discharge portions has a length of less than 45 mm, a molten steel flow is discharged in a direction different from an axial direction of an outlet port in each of the discharge portions, particularly downwardly relative to the axial direction. Thus, the molten steel flow is largely spread just after molten steel is discharged from the outlet port, and thereby significantly decelerated (see Fm in FIG. 30). Moreover, an upward flow is highly likely to rapidly occur just after molten steel is discharged from the outlet port to cause local turbulences on a molten steel surface, such as so-called "upwelling", which increases the risk of incorporation of a mold powder, etc. (see Fm, 3 in FIG. 30).

Moreover, in the conventional immersion nozzle where each of the discharge portions has a length of less than 45 mm, two molten steel flows discharged from the respective outlet ports located in bilaterally symmetrical relation to each other are more likely to be directed in vertically different directions periodically or non-periodically, in such a manner that one of the molten steel flows is discharged upwardly from one of the outlet ports, and the other molten steel flow is discharged downwardly from the other outlet port, to cause frequent occurrence of turbulence phenomenon, such as "wave", "heave" and "change in flow direction" (see Fm, 3 in FIG. 31). Differently, in the immersion nozzle of the present invention, the discharge portions each having a length of 45 mm or more makes it possible to eliminate the above turbulence phenomenon in molten steel flows (see Fm, 3 in FIG. 29).

The length of the discharge portion having the outlet port is essentially required to be 45 mm or more in any position thereof. A start point for measuring the length is any point (e.g., 13 in FIG. 3(*a*)) of an intersecting line between an inner hole surface of the straight nozzle body and an inwardmost (i.e., upstreammost) edge of the inner wall surface defining a space of the outlet port, and a terminal point for measuring the length is any point (see 14 in FIG. 3(*a*)) of an outwardmost (i.e., downstreammost) edge of the inner wall surface, which lies on a line extending from the start point in a radial direction relative to an axis of the straight nozzle body, i.e., in a laterally outward direction of the immersion nozzle, in parallel to the axial direction of the outlet port. In a vertical cross-section taken along the axis of the outlet port, an edge of the outlet port on the side of the terminal point is preferably formed in a linear line (i.e. flat or plane surface). Alternatively, the edge of the outlet port may be formed in a curved line depending on the configuration of the inner hole or outer peripheral surface of the straight nozzle body. The linear edge of the outlet port may be parallel to the axis of the straight nozzle body (see FIGS. 3(*a*), 4(*a*) and 5(*a*)) or may be perpendicular to the axis of the outlet port (see FIG. 6(*a*)).

In an immersion nozzle where the requirement about the length of 45 mm or more is satisfied only a portion of an outlet port, for example, in the immersion nozzle having the canopy-like members disposed above and below an outlet port as disclosed in the aforementioned Patent Publication 2, molten steel discharged from a region which is not covered by the canopy-like members, i.e., a region where the length is less than 45 mm, will be spread in a direction away from an axial direction of the outlet port. Moreover, a deflected flow is liable to occur in boundary regions with the respective canopy-like members and accelerate the spreading. Therefore, the discharge portion is essentially required to have a length of 45 mm or more in any position of the inner wall surface defining a space of the outlet port.

In the immersion nozzle where the edge of the outlet port on the side of the terminal point in a vertical cross-section taken along the axis of the outlet port is perpendicular to the axis of the outlet port (see FIG. 6(*a*)), the length of the discharge portion along the axial direction of the inner wall surface defining the outlet port can vary in respective vertical positions of the inner wall surface depending on an angle of the axis of the outlet port. However, such a variation in the length of the discharge portion falls within a small range having no adverse effect on a pattern of a molten steel flow discharged from the outlet port. In this case, a minimum one of the different lengths may be set to be 45 mm or more.

An upper limit of the length of the discharge portion is not limited to a specific value. In cases where there is a factor significantly disturbing formation of a molten steel flow in an intended direction, for example when the slab extraction rate is set at a relatively high value to cause an increase in a downward flow speed, or when molten steel in the mold cavity has a strong convection flow, the length of the discharge portion may be adjusted in combination with adjustment of other parameter, such as an immersion depth (see S5 in FIG. 19) or an axial direction of the outlet port. In this case, it should be noted that a weight of the discharge portions becomes larger along with an increase in the length, which is likely to cause a trouble about a fracture of the straight nozzle body if the weight is increased beyond an allowable bending moment of the straight nozzle body.

A second requirement in the immersion nozzle of the present invention is that a ratio of S1/S2 is in the range of 0.8 to 1.8, wherein S1 is a total transverse vertical cross-sectional area of the outlet ports in perpendicular relation to an axial direction of the outlet port, and S2 is a cross-sectional area of an inner hole of the straight nozzle body taken along a plane which includes a line connecting respective uppermost positions of inwardmost edges of the outlet ports and extends in perpendicular relation to an axial direction of the straight nozzle body.

If the ratio S1/S2 is less than 0.8, a discharge flow from the excessively narrowed outlet port is likely to be bounced upwardly to cause difficulty in obtaining an intended discharge flow (see FIG. 7). Conversely, if the ratio S1/S2 is greater than 1.8, molten steel will be sucked from an upstream side of the outlet port in an excessive amount, and thereby a flow rate to be discharged from a downstream side of the outlet port is excessively increased to cause difficulty in obtaining an intended discharge flow (see FIG. 8).

The molten steel flow discharged from the outlet port with a local instability in flow speed etc., is likely to cause spreading of the molten steel flow and turbulences of the molten steel flow in the mold cavity, and adversely affect slab quality due to incorporation of a mold powder, etc. Thus, in order to obtain a uniform flow speed so as to reliably suppress occurrence of a downward flow and a reversed flow, it is essentially required to set the ratio S1/S2 in the range of 0.8 to 1.8.

A third requirement in the immersion nozzle of the present invention is that the axis of each of the outlet ports extends laterally outwardly and downwardly at an angle θt falling within the following range with respect to a horizontal direction: $0° \leqq \theta t \leqq 20°$. If the angle θt is set to allow the axis of the outlet port to extend laterally outwardly and upwardly with respect to the horizontal direction, a molten steel flow will be excessively decelerated and formed as a curved flow before reaching the lateral end of the mold cavity, i.e., lateral wall of the mold, to preclude formation of a linear flow (see FIG. 12). Conversely, if the angle θt is set at a value greater than 20° with respect to the horizontal direction, a molten steel flow will be excessively decelerated due to resistance of molten steel in the mold cavity and formed as a curved flow before reaching the lateral end of the mold cavity, i.e., lateral wall of the mold, to preclude formation of a linear flow (see FIG. 13).

The effects of the immersion nozzle meeting the above first to third requirements become most prominent when the immersion nozzle is used for pouring molten steel into a mold having a mold cavity formed with a substantially rectangular-shaped horizontal cross-section having a long side of 2000 mm or more and a short side of 150 mm or less, at a throughput range of 1.8 to 4.5 tons/min. If the immersion nozzle is used for pouring molten steel into the mold cavity formed with a substantially rectangular-shaped horizontal cross-section having a long side of 2000 mm or more and a short side of 150 mm or less, at a throughput range of less than 1.8 tons/min, an intended linear molten steel flow cannot adequately reach the lateral end of the mold cavity to cause difficulty in stably forming an upward flow and a molten steel flow required in a vicinity of a molten steel surface in the entire mold cavity (i.e., reversed flow) (see FIG. 14). Conversely, if the immersion nozzle is used for pouring molten steel into the mold cavity, at a throughput range of greater than 4.5 tons/min, an intended linear molten steel flow is likely to cause undesirable turbulences around the immersion nozzle (see encircled regions in FIG. 15).

Thus, preferably, the immersion nozzle of the present invention is presupposed to be used for pouring molten steel into a mold having a mold cavity formed with a substantially rectangular-shaped horizontal cross-section having a long side of 2000 mm or more and a short side of 150 mm or less, at a throughput range of 1.8 to 4.5 tons/min.

That is, the immersion nozzle of the present invention which meet the above first and third requirements and preferably based on the above presupposition can discharge molten steel into the mold cavity formed with a substantially rectangular-shaped horizontal cross-section having a long side of 2000 mm or more and a short side of 150 mm or less, substantially in a preset (intended) axial direction (see Dt=Dm, Δθ=0 in FIG. 11(*b*)) of the outlet port, and can maintain a molten steel flow until it reaches a lateral end of the mold cavity having a width (i.e., long side) of 2000 mm or more (see FIG. 29), without occurrence of a stagnant region (see 7, 8 in FIG. 1(*a*)).

In contrast, in an immersion nozzle having a conventional outlet port, a molten steel flow starts largely spreading just after being discharged from the outlet port to cause occurrence of local deflected flows and turbulences in various regions of the mold cavity including a vicinity of the outlet port, and episodic occurrence of fluctuation ("wave", etc.) in the molten steel surface due to the deflected flows and turbulences, to lead to incorporation of a mold powder and inclusions into a slab (see FIG. 31). Differently, the immersion nozzle of the present invention can suppress spreading of a molten steel flow over a long distance to prevent occurrence of the above undesirable phenomenon.

In the present invention, the immersion nozzle is required to have a bilaterally symmetrical shape with respect to a cross-section thereof taken along the axis of the straight nozzle body and along a thickness (i.e., short side) direction of the mold cavity when it is immersed in the mold cavity. Specifically, during use, the immersion nozzle of the present invention is disposed at a lateral (i.e., widthwise) center of the mold cavity to discharge molten steel from the pair of outlet ports in respective opposite lateral (i.e., widthwise) directions of the mold cavity. In this case, in order to prevent turbulences from occurring, particularly, in a widthwise molten steel flow, it is necessary to allow the molten steel flows to be discharged evenly in terms of direction and flow speed (see Fm in FIG. 29).

As mentioned above, the immersion nozzle of the present invention makes it possible to stably form a molten steel flow required in a vicinity of a molten steel surface in a lateral end of a mold cavity and in a vicinity of a molten steel surface in the entire mold cavity, particularly, in a continuous casting process of pouring molten steel into a mold having a mold cavity formed with a substantially rectangular-shaped horizontal cross-section having a long side (i.e., width) of 2000 mm or more and a short side (i.e., thickness) of 150 mm or less.

Based on the desirable molten steel flow, the immersion nozzle of the present invention can suppress incorporation of a mold powder and inclusions into a slab while suppressing a reduction in temperature in an upper region of the lateral end of the mold cavity, so as to provide stable and enhanced equality in slabs and enhanced safety in a continuous casting process.

Generally, parameters for a continuous casting operation, such as a molten-steel supply rate, a slab extraction rate, dimensions of a mold cavity, and properties of a mold powder, are changed depending on conditions unique to individual production sites, such as a type of steel and a production plan, and parameters for an immersion nozzle, such as an axial direction of each outlet port and an immersion depth, are optimally adjusted in response to changes in the parameters for the continuous casting operation. In this situation, the immersion nozzle of the present invention capable of forming a molten steel flow in an intended direction while suppressing deceleration of the molten steel flow has an advantage of being able to adequately cope with various operational conditions where flow patterns and flow speeds of molten steel and a mold powder largely vary according to the above adjustment, and facilitate obtaining an intended optimal molten steel flow with a high degree of accuracy.

BRIEF DESCRIPTION OF THE DRAWINGS

FIGS. 3(*a*) to 3(*c*) illustrate an encircled region A in FIG. 2, wherein: FIG. 3(*a*) is a sectional view taken along the line A-A in FIG. 3(*c*); FIG. 3(*b*) is a sectional view taken along the line B-B in FIG. 3(*a*); and FIG. 3(*c*) is a fragmentary side view of the immersion nozzle when viewed from the direction C in FIG. 3(*a*).

FIGS. 4(*a*) to 4(*c*) illustrate a part of an immersion nozzle having a pair of discharge portions as one type of segmental structure, according to another embodiment of the present invention, corresponding the encircled region A in FIG. 2, wherein: FIG. 4(*a*) is a sectional view taken along the line A-A in FIG. 4(*c*); FIG. 4(*b*) is a sectional view taken along the line B-B in FIG. 4(*a*); and FIG. 4(*c*) is a fragmentary side view of the immersion nozzle when viewed from the direction C in FIG. 4(*a*).

FIGS. 5(*a*) to 5(*c*) illustrate a part of an immersion nozzle having a pair of discharge portions as another type of segmental structure, according to another embodiment of the present invention, corresponding the encircled region A in FIG. 2, wherein: FIG. 5(*a*) is a sectional view taken along the line A-A in FIG. 5(*c*); FIG. 5(*b*) is a sectional view taken along the line B-B in FIG. 5(*a*); and FIG. 5(*c*) is a fragmentary side view of the immersion nozzle when viewed from the direction C in FIG. 5(*a*).

FIGS. 6(*a*) to 6(*c*) illustrate a part of an immersion nozzle having a pair of discharge portions as another type of segmental structure, according to another embodiment of the present invention, corresponding the encircled region A in FIG. 2, wherein: FIG. 6(*a*) is a sectional view taken along the line A-A in FIG. 6(*c*); FIG. 6(*b*) is a sectional view taken along the line B-B in FIG. 6(*a*); and FIG. 6(*c*) is a fragmentary side view of the immersion nozzle when viewed from the direction C in FIG. 5(*a*).

FIGS. 10(*a*) to 10(*c*) illustrate an encircled region A in FIG. 9, wherein: FIG. 10(*a*) is a sectional view taken along the line A-A in FIG. 10(*c*); FIG. 10(*b*) is a sectional view taken along the line B-B in FIG. 10(*a*); and FIG. 10(*c*) is a fragmentary side view of the conventional immersion nozzle when viewed from the direction C in FIG. 10(*a*).

DETAILED DESCRIPTION OF THE PREFERRED EMBODIMENTS

With reference to the drawings, the present invention will now be specifically described.

A production method for an immersion nozzle of the present invention will be firstly described.

The immersion nozzle of the present invention may be produced by a conventional process using a compound clay, for example, comprising kneading a refractory material together with a binder added thereto to prepare a compound clay, subjecting the compound clay to a CIP (Cold Isostatic Press) process while placing a core or a rubber mold having a length of 45 mm or more, in a position corresponding to an inner wall surface, to form a product integral with a pair of discharge portions, and then subjecting the obtained product to drying, burning, and finishing, such as grinding.

Figure 2:
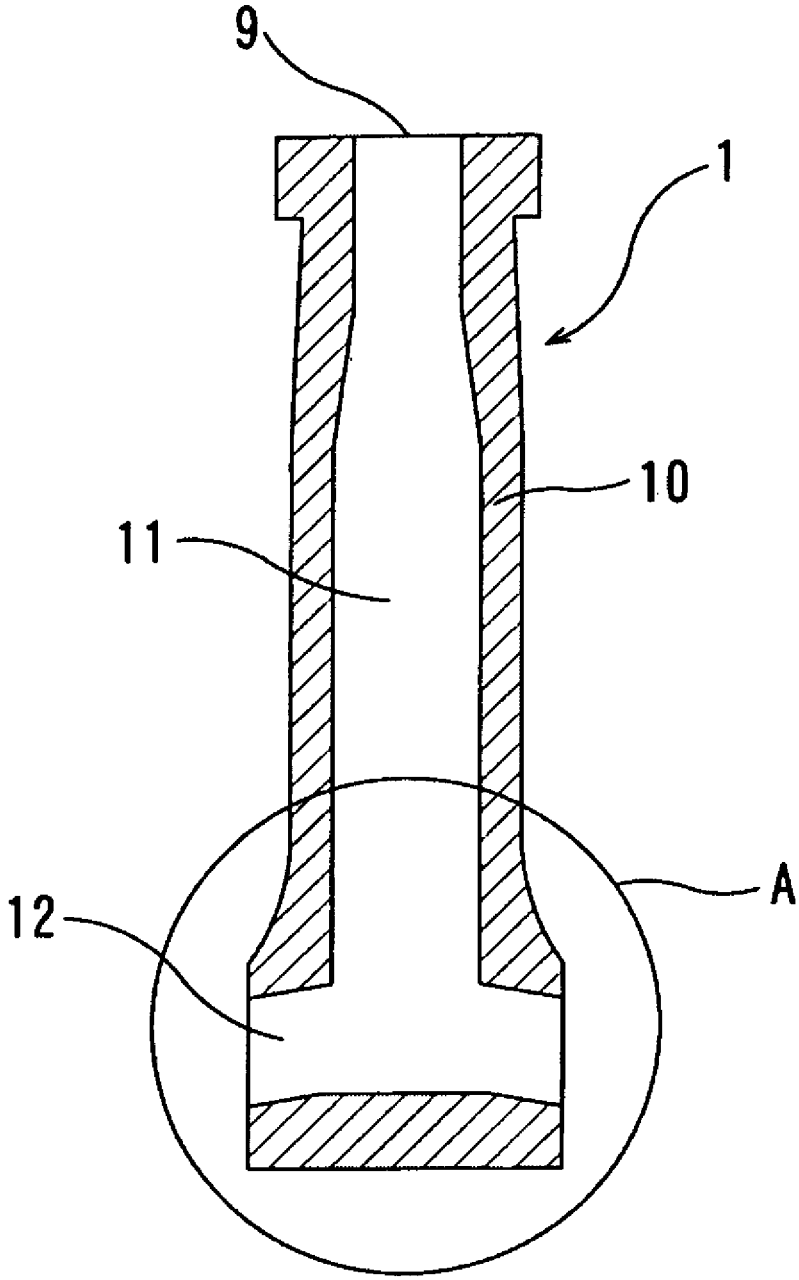
FIG. 2 is a sectional view of an immersion nozzle having a pair of discharge portions as an integral structure, according to one embodiment of the present invention, taken along an axis of a straight nozzle body thereof.
Figure 3:
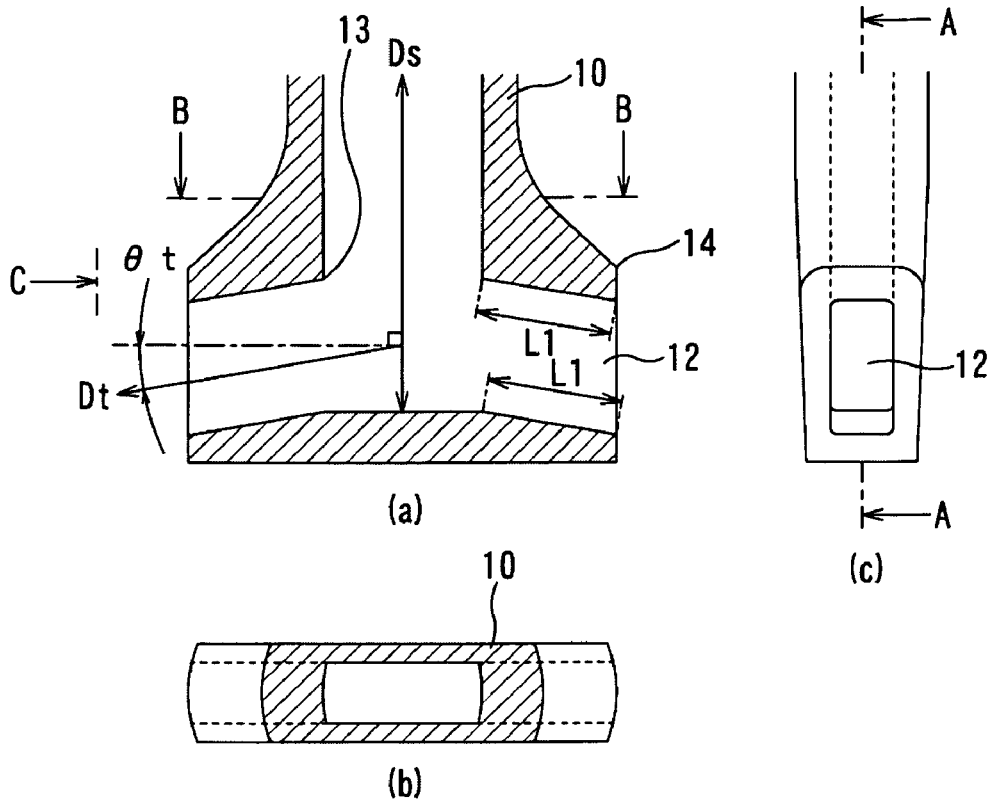

A pair of discharge portions (a pair of portions each protruding from a body of an immersion nozzle (straight nozzle body)) each having an inner wall surface which defines an outlet port therein and a length thereof at 45 mm or more may be integrally formed with the straight nozzle body as a single piece structure (see FIGS. 2 and 3).

In a process of forming the inner wall surface defining the outlet port, a refractory wall having an inner wall surface with a length of 45 mm or more may be formed to protrude from a straight nozzle body of an immersion nozzle. In the process of forming the discharge portions (i.e., protruding portions) integrally with the straight nozzle body, a pair of cores for the outlet ports, which are prepared separately from a core for the straight nozzle body, may be attached to the core for the straight nozzle body in a detachable manner, and then detached after the forming process. Alternatively, a core made of a material capable of being molted or evaporated at high temperatures, such as wax, may be used for forming an integral structure having an internal space (i.e., an inner hole of the straight nozzle portion and/or the outlet ports of the discharge portions). Alternatively, a compound clay for the protruding portions may be integrally formed with a compound clay for the straight nozzle portion, to have a given length, and then holes may be bored to form the outlet ports after the forming process.

Figure 4:
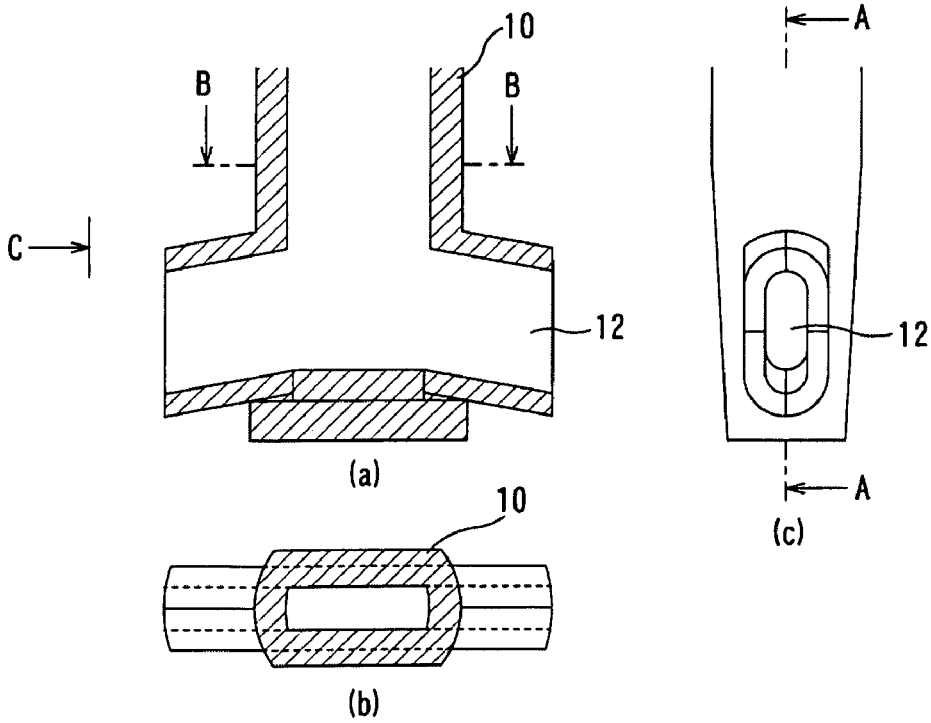
Figure 5:
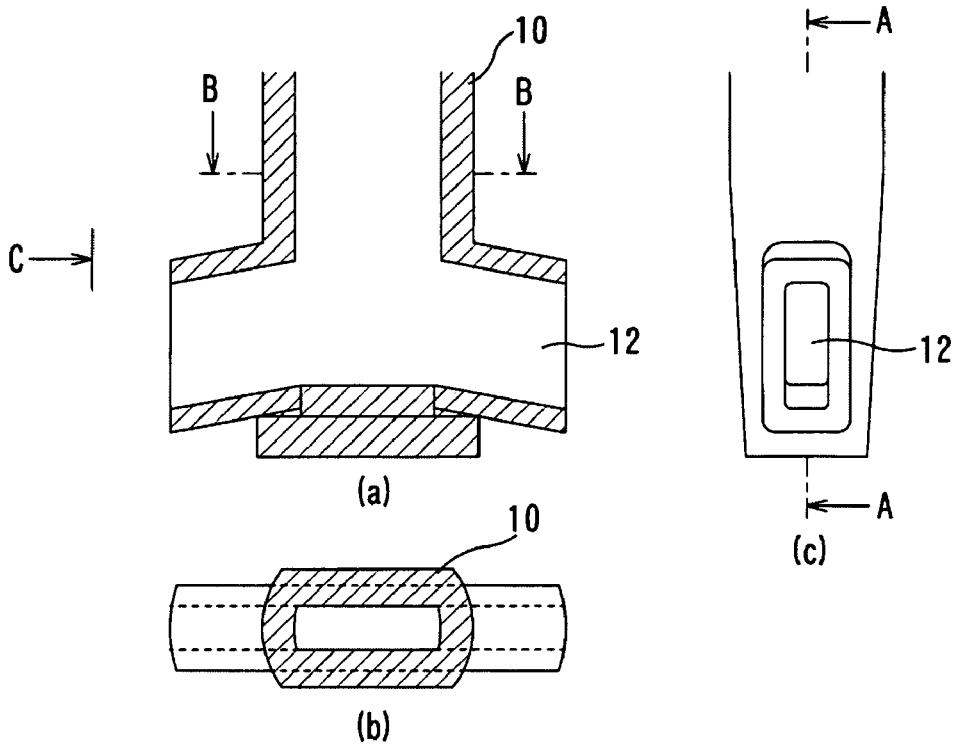
Figure 6:
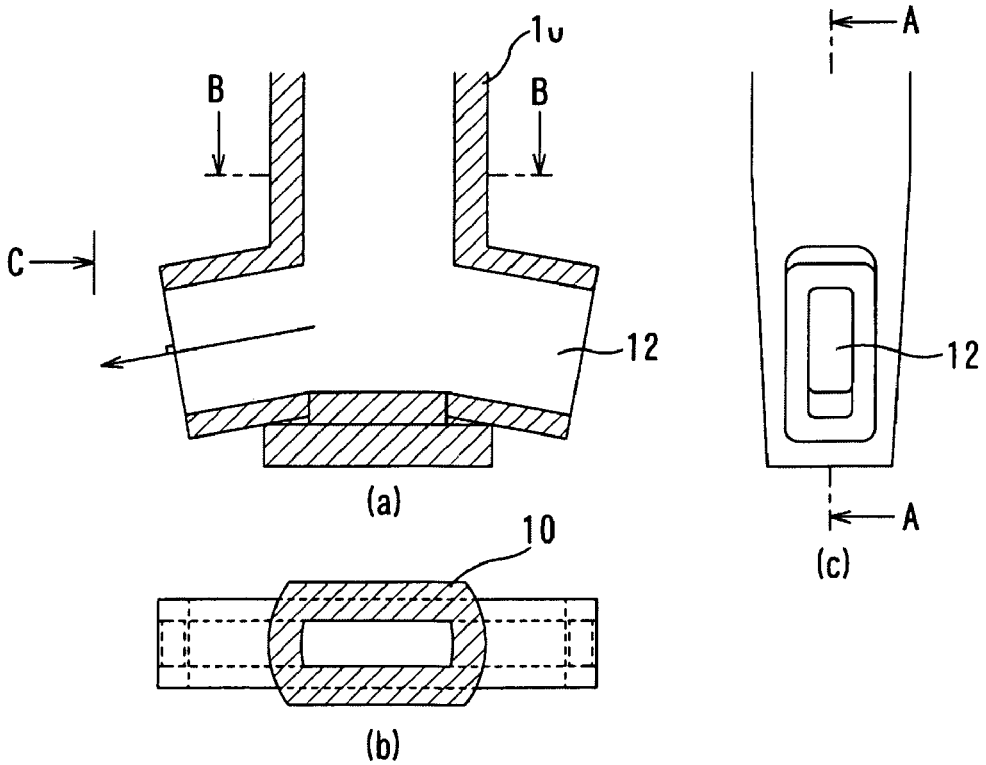
Figure 7:
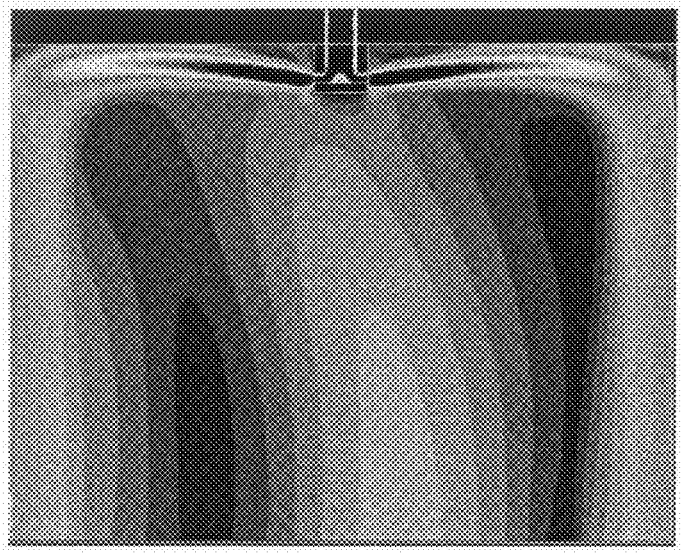
FIG. 7 is a pattern diagram showing a flow in a mold cavity under a condition that a ratio of S1/S2 is less than 0.8, wherein S1 is a total transverse vertical cross-sectional area of a pair of outlet ports of an immersion nozzle, and S2 is a cross-sectional area of an inner hole of a straight nozzle body of the immersion nozzle, taken along a plane which includes a line connecting respective uppermost positions of inwardmost edges of the outlet ports and extends in perpendicular relation to an axial direction of the straight nozzle body.
Figure 8:
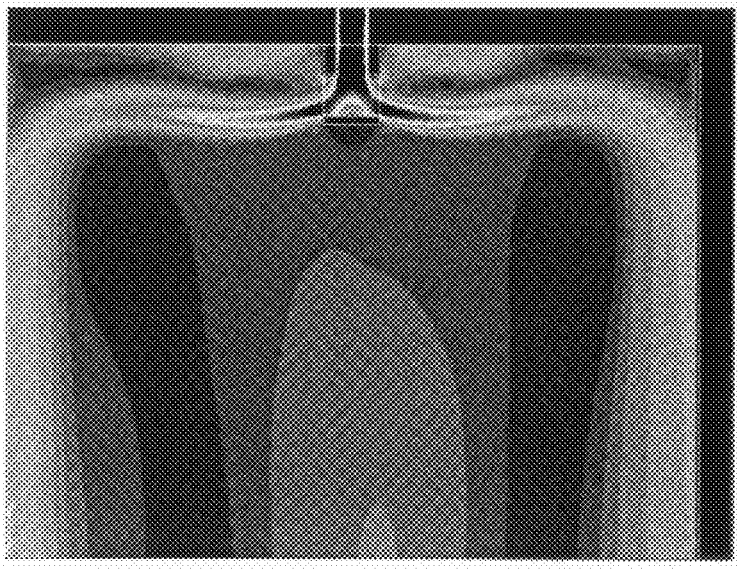
FIG. 8 is a pattern diagram showing a flow in the mold cavity under a condition that the ratio S1/S2 is greater than 1.8.
Figure 9:
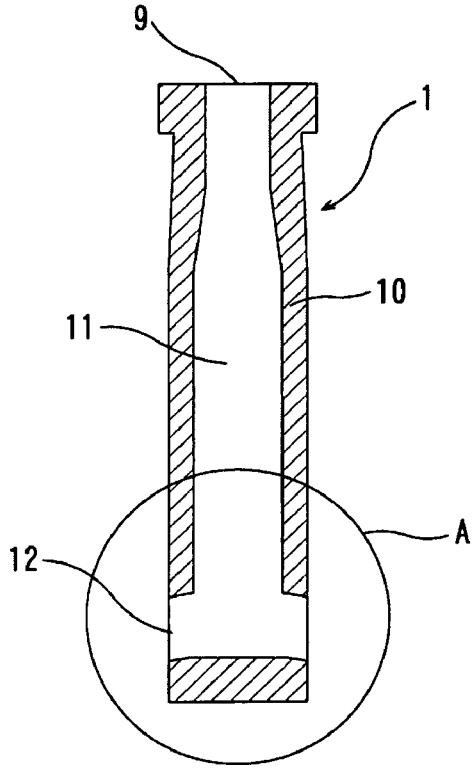
FIG. 9 is a sectional view of a conventional immersion nozzle, taken along an axis of a straight nozzle body thereof.
Figure 10:
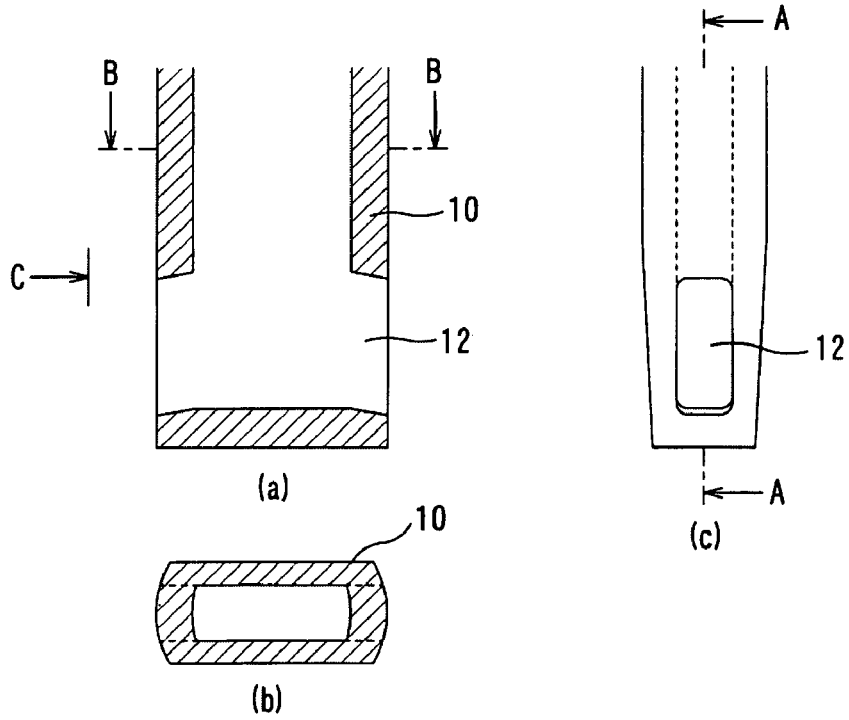

In place of the process of simultaneously forming the discharge portions (protruding portions) each including the outlet port, and the straight nozzle body, as an integral structure, the discharge portions may be formed as a separate component from the straight nozzle body, and then joined to the straight nozzle body. More specifically, an immersion nozzle body (straight nozzle body) may be prepared in such a manner that the discharge portions each including the outlet port are not pre-formed therein and a portion around each of a pair of outlet openings thereof (i.e., wall of the immersion nozzle body) does not have the length as defined by the present invention, and then a pair of protrusion portions prepared as a separate component from the immersion nozzle body may be assembled to the immersion nozzle body (i.e., to the respective outlet openings of the straight nozzle body) to form the discharge portions (see FIGS. 4, 5 and 6).

In the process of forming the immersion nozzle of the present invention, it is necessary to give consideration, particularly, to handling of the discharge portions. Specifically, in a process of forming the discharge portions in such a manner as to protrude from the straight nozzle body, the discharge portions are likely to be damaged due to external force during operations for the forming process and subsequent transport. In order to prevent stress concentration to the discharge portions and damages of the discharge portions due to external force during production process, and thermal shock and continuous external force from a molten steel flow during use, a region changing from the straight nozzle body to each of the protruding discharge portions (a base region of the discharge portion) is preferably formed in a tapered shape or a rounded shape. The taper angle or a curvature is not limited to a specific value, but is preferably set at a relatively large value.

EXAMPLE

Test 1

Test 1 was carried out to check conditions of a length of each of the discharge portions required for allowing molten steel just after being discharged from each of the outlet ports to flow while maintaining an intended direction, i.e., a setup angle of the inner wall surface defining the outlet port (a setup angle of an axial direction of the outlet port in the discharge portion).

Figure 16:
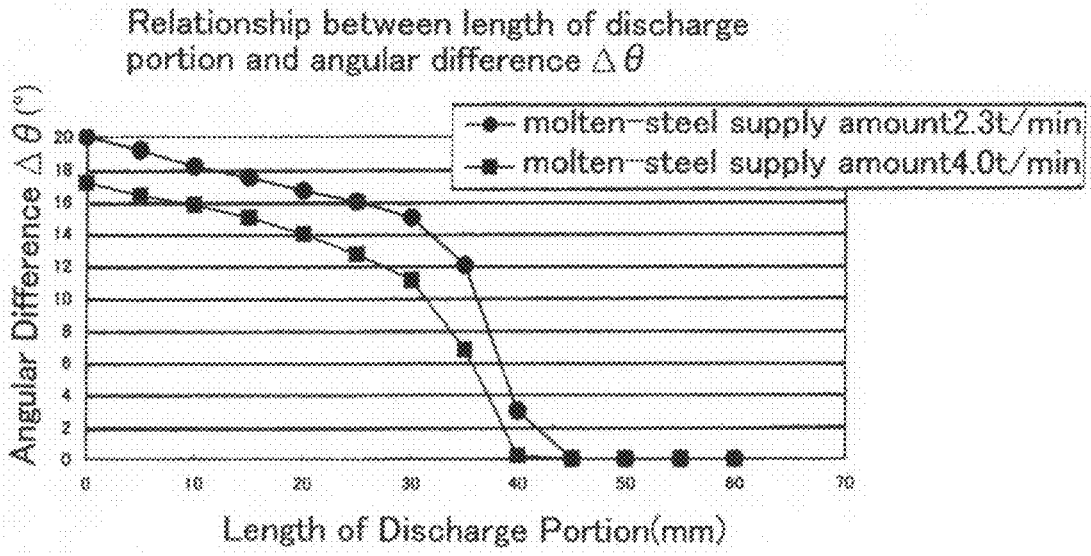
FIG. 16 is a graph showing a relationship between a length of a discharge portion having an outlet port and an angular difference (Δθ) between an axial direction of the outlet port and a discharge direction of a molten steel (water) flow.

TABLE 1 and FIG. 16 show a relationship between a length of a discharge portion and a discharge direction of a molten steel (water) flow.

Test 1 was performed based on a water model. Operational conditions of a presupposed actual casting operation were as follows: a cross-section of the straight nozzle body=11.7 cm long side×4.3 cm short side (corners are rounded); a cross-sectional area (S2) of an inner hole of the straight nozzle body=50.3 $cm^2$; a total cross-sectional area (S1) of the outlet ports=64.5 $cm^2$; the ratio S1/S2=1.28; and a molten-steel flow rate=2.3 to 4.0 tons/min (0.036 to 0.062 tons/min·$cm^2$ per unit area of the outlet port). Given that a slab extraction rate is set in the range of 1.3 to 1.37 m/min, and a thickness (i.e., short side) of the mold cavity is set at 150 mm, the above conditions correspond to an casting operation in a mold cavity having a width (i.e. long side) of about 1500 to 2500 mm.

Conditions of the water model test determined correspondingly to the above presupposed actual operational conditions were as follows. A full-sized wooden device was used as an immersion nozzle. As a representative example, the outlet port was designed to have an axial direction oriented laterally outwardly and downwardly at an angle of 10° with respect to a horizontal direction, and a quadrangular columnar shape with a rectangular-shaped transverse vertical cross-section of 75 mm long side×43 mm short side (corners are rounded). A height direction of the quadrangular columnar shape corresponds to an axial direction of an inner wall surface defining the outlet port. A water supply rate was set in the range of 0.0046 to 0.008 tons/min·cm$^2$.

Figure 11:
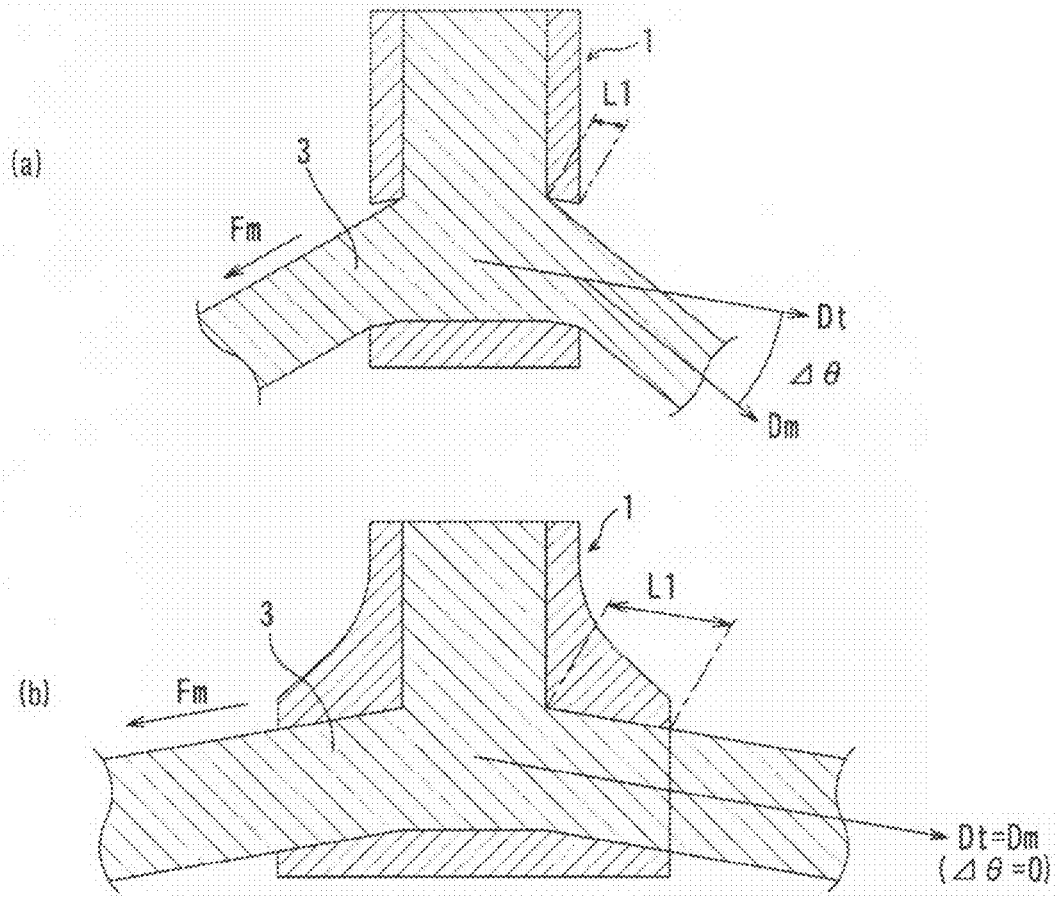
FIGS. 11(*a*) and 11(*b*) are conceptual fragmentary sectional views showing a molten steel flow discharged from a pair of outlet ports of an immersion nozzle, corresponding to the encircled region A in FIG. 9, wherein FIG. 11(*a*) shows a molten steel flow based on a conventional immersion nozzle, and FIG. 11(*b*) shows a molten steel flow based on an immersion nozzle according to the present invention.
Figure 12:
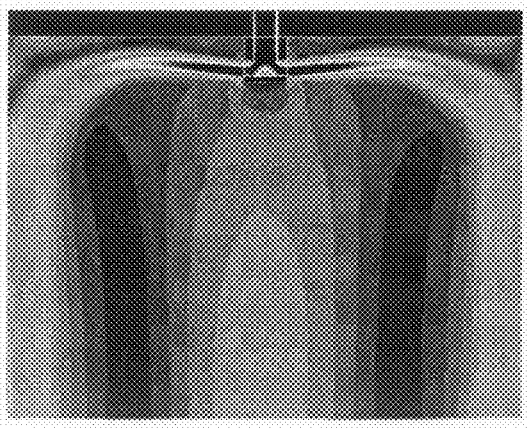
FIG. 12 is a pattern diagram showing a flow in the mold cavity under a condition that an axis of each of a pair of outlet ports of an immersion nozzle is designed to extend laterally outwardly and upwardly with respect to a horizontal direction at an angle θt of 10°.
Figure 13:
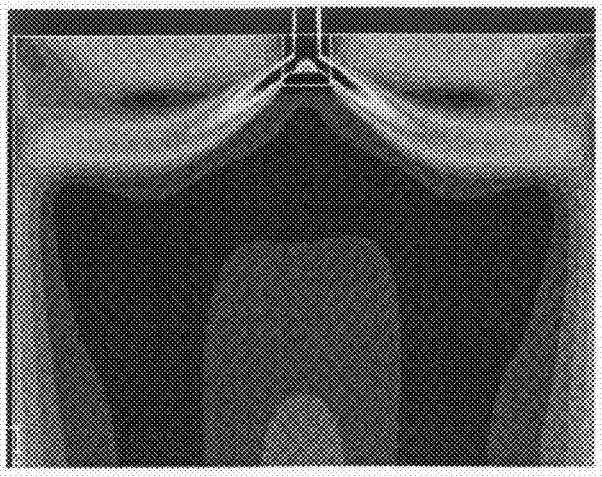
FIG. 13 is a pattern diagram showing a flow in the mold cavity under a condition that the axis of each of the pair of outlet ports of the immersion nozzle is designed to extend laterally outwardly and downwardly with respect to the horizontal direction at an the angle θt of 30°.
Figure 14:
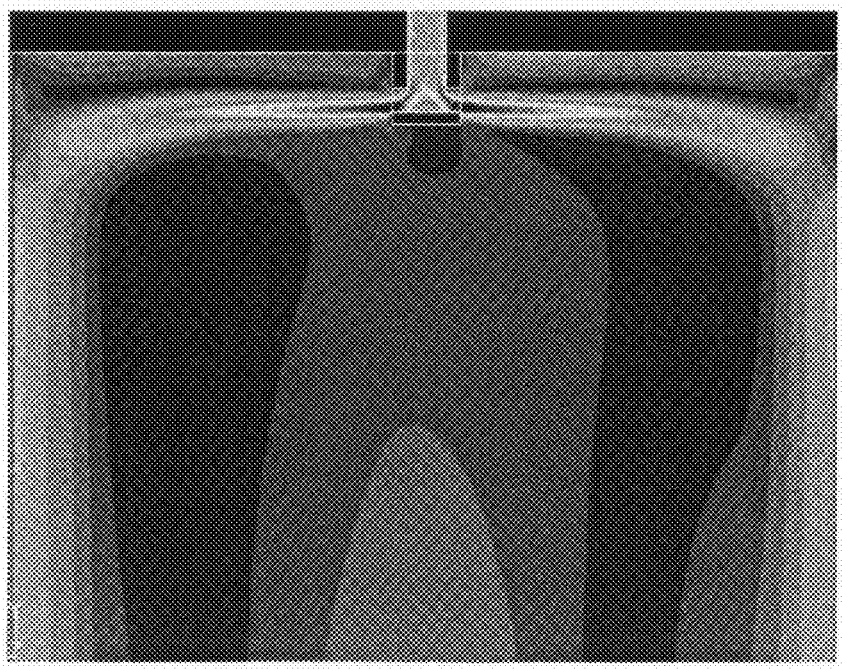
FIG. 14 is a pattern diagram showing a flow in the mold cavity under a condition that a throughput is less than 1.8 tons/min.
Figure 15:
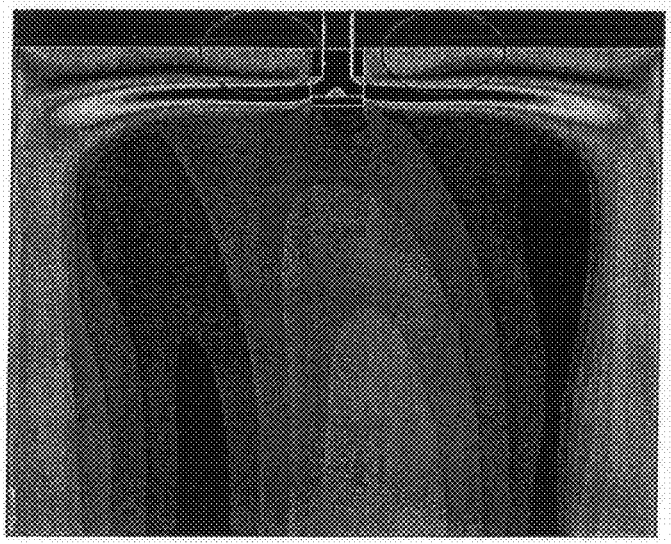
FIG. 15 is a pattern diagram showing a flow in the mold cavity under a condition that the throughput is greater than 4.5 tons/min.

In Test 1, a plurality of samples different in the axial length of the outlet port were prepared, and a water flow discharged from the outlet port in each of the samples was subjected to visual and photographic observation so as to measure an angular difference (Δθ in FIG. 11(*a*)) between a discharge direction of water (Dm in FIG. 11(*a*)) and the axial direction of the outlet port.

As also shown in FIG. 16, under any condition that a converted molten-steel flow rate is in the range of 2.3 to 4.0 tons/min, the angular difference (Δθ in FIG. 11(*a*)) between a discharge direction of water and the axial direction of the outlet port sharply starts decreasing when the length of the discharge portion is increased to about 35 mm. Then, the angular difference becomes significantly low when the length of the discharge portion is increased to 40 mm or more, and becomes zero degree when the length of the discharge portion is increased to 45 mm or more (Dm=Dt, Δθ=0° in FIG. 11(*b*)).

As evidenced by the above test result, in current continuous casting operations, under a condition the mold cavity has a width (i.e., long side) ranging from 2000 mm to at least about 2500 mm, as long as the length of the discharge portion in an immersion nozzle for use in the mold cavity is 45 mm or more, an intended flow can be stably obtained based on the above outlet port.

TABLE 1

| Molten steel supply amount | (ton/min) *1 | 2.3 | 4 |
|---|---|---|---|
| | (ton/min · cm$^2$) *2 | 0.036 | 0.062 |
| | length of discharge portion (mm) | | |
| Angular difference Δθ (°) | 0 | 20 | 17.2 |
| | 5 | 19.2 | 16.4 |
| | 10 | 18.2 | 15.8 |
| | 15 | 17.5 | 15 |
| | 20 | 16.7 | 14 |
| | 25 | 16 | 12.7 |
| | 30 | 15 | 11.1 |
| | 35 | 12 | 6.8 |
| | 40 | 3 | 0.2 |
| | 45 | 0 | 0 |
| | 50 | 0 | 0 |
| | 55 | 0 | 0 |
| | 60 | 0 | 0 |

*1 total supply amount converted to molten steel
*2 supply amount per unit area of outlet port converted to molten steel Test 2

In addition to verification of the effects of the present invention based on the water model in Test 1, Test 2 was carried out to verify an influence of the ratio S1/S2 (wherein S1 is a total transverse vertical cross-sectional area of the outlet ports, and S2 is a cross-sectional area of an inner hole of the straight nozzle body taken along a plane which includes a line connecting respective uppermost positions of inwardmost edges of the outlet ports and extends in perpendicular relation to an axial direction of the straight nozzle body) on an intended flow, through a computer-based fluid flow analysis.

This verification was performed using a CFD software (FLUENT produced by FLUENT Inc.).

Figure 19:
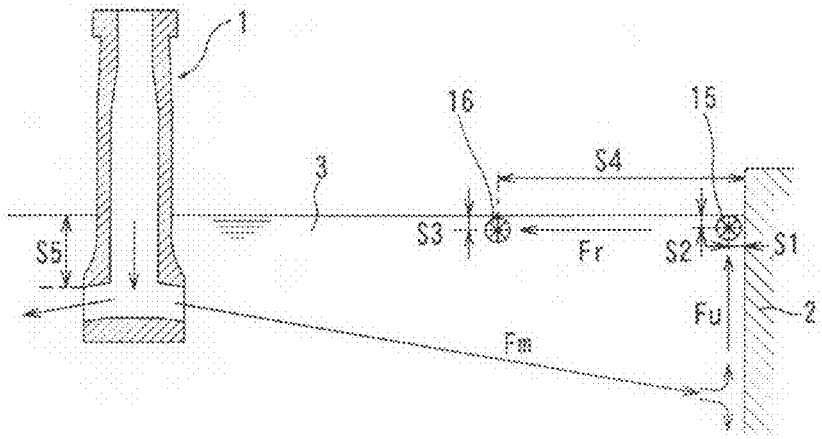
FIG. 19 is a conceptual sectional view showing an arrangement of devices and a water flow in Test 4, taken-along a widthwise direction of a mold cavity.

Operational conditions of a presupposed actual casting operation, i.e., input data for calculations were as follows: the cross-section of the straight nozzle body=11.7 cm long side× 4.3 cm short side (corners are rounded); the cross-sectional area (S2) of the inner hole of the straight nozzle body=50.3 cm$^2$; the total cross-sectional area (S1) of the outlet ports=32.25 to 129 cm$^2$; the ratio S1/S2=0.64 to 2.56; an angle of the axial direction of the outlet port=10° (laterally outwardly and downwardly relative to the horizontal direction); an immersion depth (a distance between a molten steel surface and an uppermost position of an outwardmost edge of the outlet port; see S5 in FIG. 19)=110 mm; and a configuration of the outlet port=a quadrangular columnar shape with a rectangular-shaped transverse vertical cross-section of 37.5 ~150 mm long side×43 mm short side (a height direction of the quadrangular columnar shape corresponds to the axial direction of the inner wall surface defining the outlet port).

In terms of the length of discharge portion, two types of inventive samples were prepared: one type had a minimum length of 45 mm; and the other type has a maximum length of 150 mm which was provisionally determined in view of practicality or reality, such as productability and cost performance, and a comparative sample (conventional immersion nozzle) having a length of 35 mm was prepared. Two molten-steel flow rates were set: one molten-steel supply amount=2.3 tons/min; and the other molten-steel supply amount=4.0 tons/min (0.036 tons/min·cm$^2$ and 0.062 tons/min·cm$^2$, per unit area of the outlet port, respectively). The thickness (i.e., short side) of the mold cavity is set at 150 mm.

Figure 17:
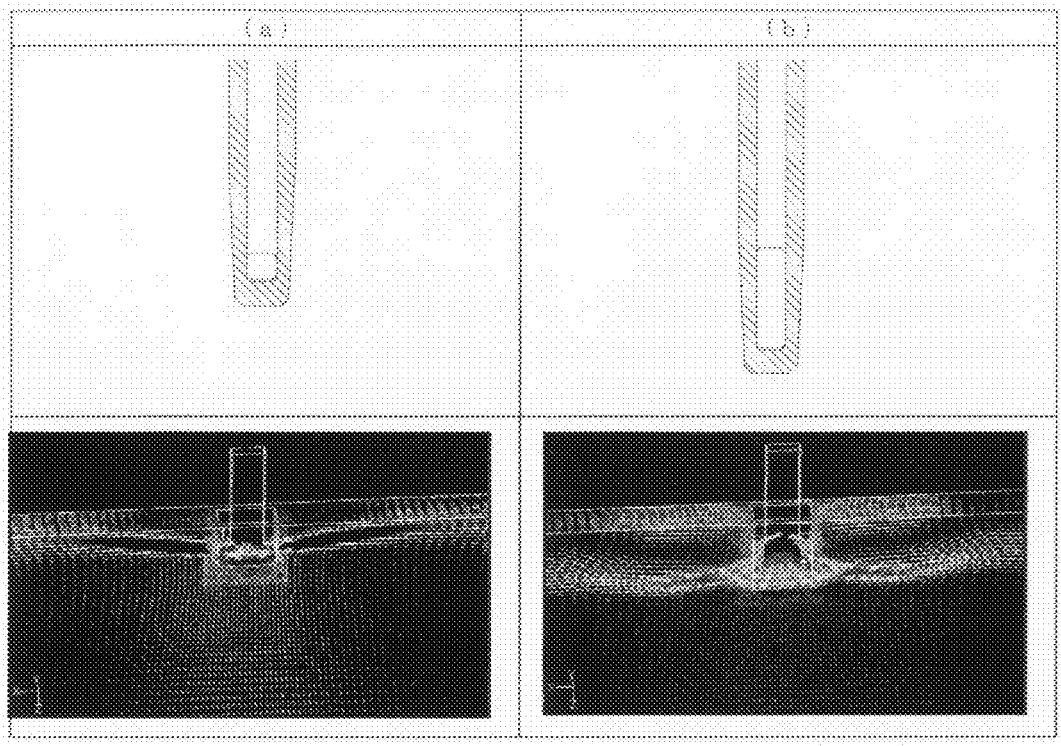
FIGS. 17(*a*) and 17(*b*) illustrate examples of an analytical result of a flow in the mold cavity, wherein FIG. 17(*a*) shows an analytical result of an immersion nozzle in which the ratio S1/S2 is less than 0.8, and FIG. 17(*b*) shows an analytical result of an immersion nozzle in which the ratio S1/S2 is greater than 1.8.

Table 2 shows a result of Test 2, and FIGS. 17 (*a*) and 17(*b*) show respective flows in the mold cavity wherein the long side of the outlet port was set at 37.5 mm and 150 mm, respectively.

TABLE 2

| | | Comparative Example 1 | Inventive Example 1 | Inventive Example 2 | Comparative Example 2 | Inventive Example 3 | Inventive Example 4 |
|---|---|---|---|---|---|---|---|
| Length of discharge portion (mm) | | 35 | 45 | 150 | 35 | 45 | 150 |
| Molten-steel supply amount | t/min | | 4.0 | | | 2.3 | |
| | t/min · cm$^2$ | | 0.062 | | | 0.036 | |

TABLE 2-continued

| Width of mold cavity (mm) | S1/S2 | Angular difference θ | | | Angular difference θ | | |
|---|---|---|---|---|---|---|---|
| 1500 | 0.64 | +9 | −11 | −9 | +7 | −9 | −7 |
| | 0.80 | +12 | 0 | 0 | +12 | 0 | 0 |
| | 1.28 | +12 | 0 | 0 | +12 | 0 | 0 |
| | 1.80 | +14 | 0 | 0 | +14 | 0 | 0 |
| | 2.56 | +19 | +6 | +4 | +18 | +8 | +6 |
| 2000 | 0.64 | +7 | −9 | −7 | +5 | −7 | −5 |
| | 0.80 | +12 | 0 | 0 | +12 | 0 | 0 |
| | 1.28 | +12 | 0 | 0 | +12 | 0 | 0 |
| | 1.80 | +14 | 0 | 0 | +14 | 0 | 0 |
| | 2.56 | +18 | +8 | +6 | +17 | +10 | +8 |
| 2500 | 0.64 | +5 | −7 | −5 | +3 | −5 | −3 |
| | 0.80 | +12 | 0 | 0 | +12 | 0 | 0 |
| | 1.28 | +12 | 0 | 0 | +12 | 0 | 0 |
| | 1.80 | +14 | 0 | 0 | +14 | 0 | 0 |
| | 2.56 | +17 | +10 | +8 | +16 | +12 | +10 |

As seen in Table 2, under any analytical condition that a molten-steel flow rate is in the range of 2.3 to 4.0 tons/min, the angular difference (Δθ in FIG. 11(*a*)) between the discharge direction of water and the axial direction of the outlet port becomes zero degree when the ratio S1/S2 (wherein S1 is a total transverse vertical cross-sectional area of the outlet ports, and S2 is a cross-sectional area of an inner hole of the straight nozzle body taken along a plane which includes a line connecting respective uppermost positions of inwardmost edges of the outlet ports and extends in perpendicular relation to an axial direction of the straight nozzle body) is in the range of 0.8 to 1.8 (Dm=Dt, Δθ=0° in FIG. 11(*b*)).

As evidenced by the above test result, in current continuous casting operations, under the condition the mold cavity has a width (i.e., long side) ranging from 2000 mm to at least about 2500 mm, as long as the length of the discharge portion and the ratio S1/S2 in an immersion nozzle for use in the mold cavity is, respectively, 45 mm or more, and in the range of 0.8 to 1.8, an intended flow can be stably obtained based on the above outlet port.

Test 3

Test 3 was carried out to verify an adequate range of the axial direction of the outlet port for allowing the intended flow verified in Tests 1 and 2 to be linearly directed in a lateral (i.e., widthwise) direction of the mold cavity having a width (i.e., long side), particularly, of 2000 mm or more, without spreading, through a computer-based fluid flow analysis.

This verification was performed using a CFD software (FLUENT produced by FLUENT Inc.).

Operational conditions of a presupposed actual casting operation, i.e., input data for calculations were as follows: the cross-section of the straight nozzle body=11.7 cm long side× 4.3 cm short side (corners are rounded); the cross-sectional area (S2) of the inner hole of the straight nozzle body=50.3 $cm^2$; the total cross-sectional area (S1) of the outlet ports=63.5 $cm^2$; the ratio S1/S2=1.28; the an immersion depth (the distance between the molten steel surface and the uppermost position of the outwardmost edge of the outlet port; see S5 in FIG. 19)=110 mm; and the configuration of the outlet port=a quadrangular columnar shape with a rectangular-shaped transverse vertical cross-section of 75 mm long side×43 mm short side (a height direction of the quadrangular columnar shape corresponds to the axial direction of the inner wall surface defining the outlet port).

An inventive sample was prepared such that the length of discharge portion was set at a minimum value of 45 mm, and the angle of the axial direction of the outlet port was set in the range of −10° to 30° (laterally outwardly and downwardly with respect to the horizontal direction). Two molten-steel flow rates were set: one molten-steel supply amount=2.3 tons/min; and the other molten-steel supply amount=4.0 tons/min (0.036 tons/min·$cm^2$ and 0.062 tons/min·$cm^2$, per unit area of the outlet port, respectively). The thickness (i.e., short side) of the mold cavity is set at 150 mm.

Figure 18:
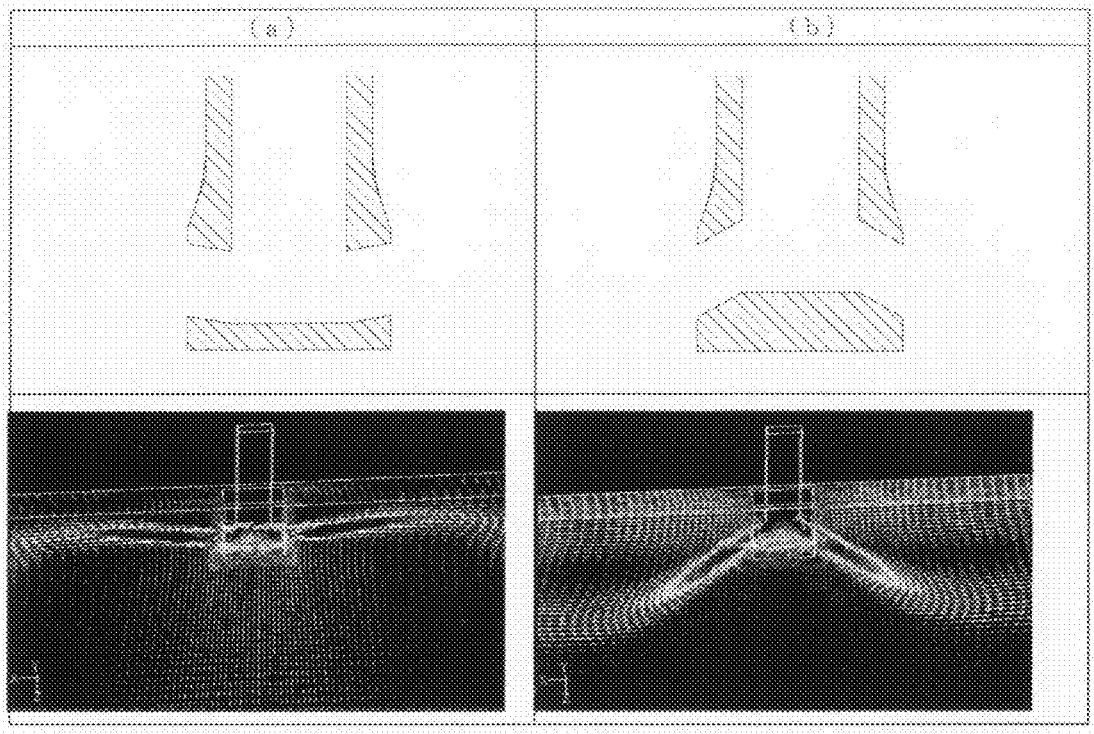
FIGS. 18(*a*) and 18(*b*) illustrate examples of an analytical result of a flow in the mold cavity, wherein FIG. 18(*a*) shows an analytical result of an immersion nozzle in which an axis of each of a pair of outlet ports is designed to extend laterally outwardly and upwardly with respect to a horizontal direction at an angle θt of 10°, and FIG. 18(*b*) shows an analytical result of an immersion nozzle in which the axis of each of the pair of outlet ports is designed to extend laterally outwardly and downwardly with respect to a horizontal direction at an angle θt of 30°.

Table 3 shows a result of Test 3, and FIGS. 18 (*a*) and 18(*b*) show respective flows in the mold cavity wherein the angle of the axial direction of the outlet port was set at −10° (i.e., 10° laterally outwardly and upperwardly with respect to the horizontal direction), and 30°(laterally outwardly and downwardly with respect to the horizontal direction), respectively.

TABLE 3

| | | Inventive Example 5 | Inventive Example 6 |
|---|---|---|---|
| Length of discharge portion (mm) | | 45 | 45 |
| Molten-steel supply amount | t/min | 4.0 | 2.3 |
| | t/min · $cm^2$ | 0.062 | 0.036 |
| Width of mold cavity (mm) | Angle | Discharge flow pattern | Discharge flow pattern |
| 1500 | −10 | curved | curved |
| | 0 | linear | linear |
| | 10 | linear | linear |
| | 20 | linear | linear |
| | 30 | curved | curved |
| 2000 | −10 | curved | curved |
| | 0 | linear | linear |
| | 10 | linear | linear |
| | 20 | linear | linear |
| | 30 | curved | curved |
| 2500 | −10 | curved | curved |
| | 0 | linear | linear |
| | 10 | linear | linear |
| | 20 | linear | linear |
| | 30 | curved | curved |

* +direction = downward direction

As seen in Table 3, under any analytical condition that a molten-steel flow rate is in the range of 2.3 to 4.0 tons/min, an adequate angle θ of the axial direction of the outlet port for allowing the intended flow to be linearly directed in the widthwise direction of the mold cavity having a width, particularly, of 2000 mm or more, without spreading, is in the following range: $0° \leqq \theta t \leqq 20°$.

As evidenced by the above test result, in current continuous casting operations, under the condition the mold cavity has a width (i.e., long side) ranging from 2000 mm to at least about 2500 mm, as long as the length of the discharge portion and the ratio S1/S2 in an immersion nozzle for use in the mold cavity is, respectively, 45 mm or more, and in the range of 0.8 to 1.8, an intended flow can be stably obtained based on the above outlet port. In addition, the axial of the outlet port can be arranged to extend laterally outwardly and downwardly at an angle θt falling within the following range with respect to a horizontal direction: $0° \leqq \theta t \leqq 20°$, to allow a molten steel flow to be linearly discharged in the widthwise direction of the mold cavity having a width of 2000 mm or more, without spreading.

Test 4

Figure 1:
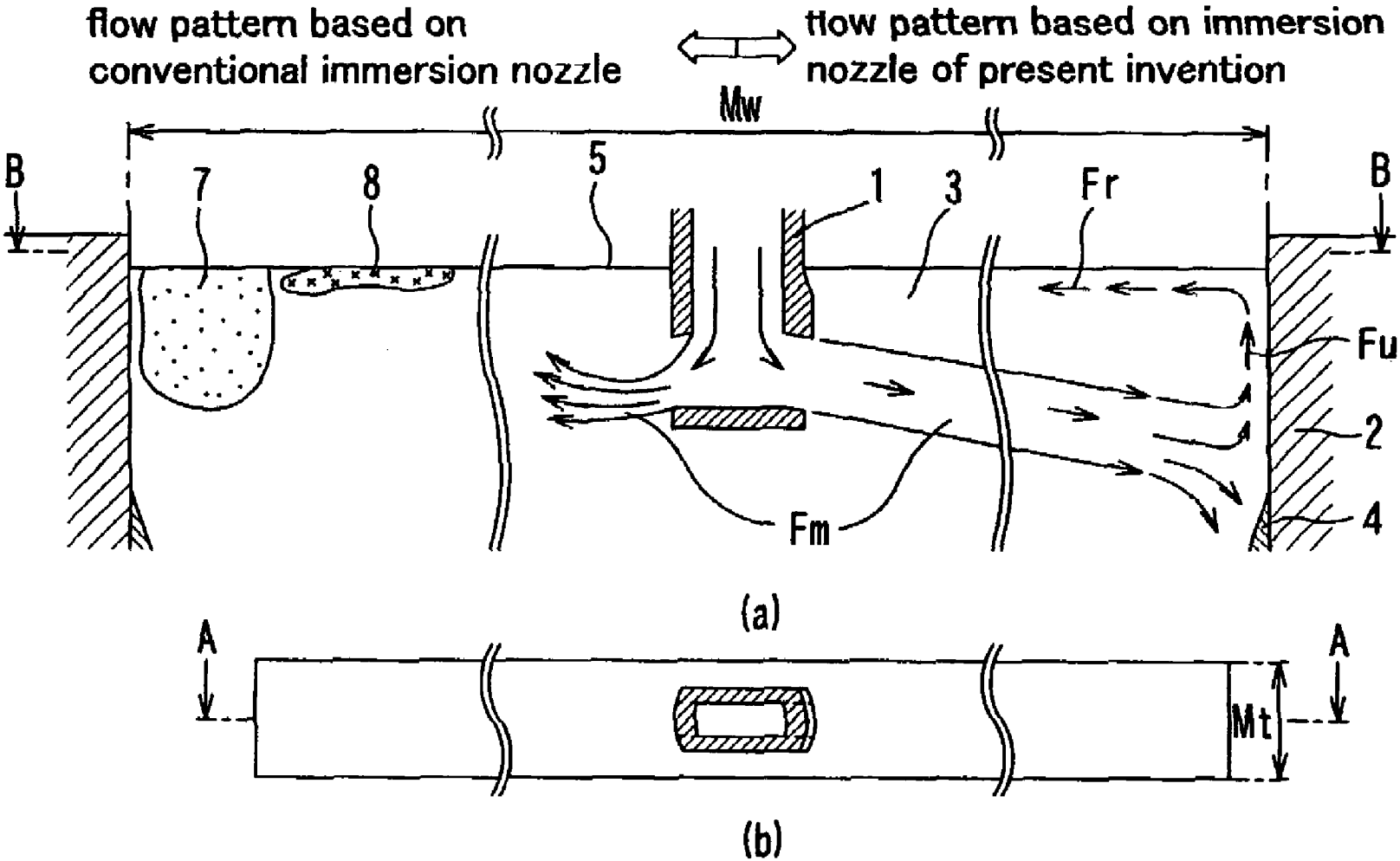
FIGS. 1(*a*) and 1(*b*) are conceptual diagrams showing a mold, wherein FIG. 1(*a*) is a sectional view showing a molten steel flow in a mold cavity, taken along the line A-A in FIG. 1(*b*) (a right half of FIG. 1(*a*) shows a molten steel flow based on an immersion nozzle according to the present invention, and a left half of FIG. 1(*a*) shows a molten steel flow based on a conventional immersion nozzle), and FIG. 1(*b*) is a sectional view taken along the line B-B in FIG. 1(*a*).

Test 4 was carried out to check an effect of the immersion nozzle of the present invention on elimination of stagnation (see 7, 8 in FIG. 1) of a molten steel flow in the lateral end of the mold cavity having a width, particularly, of 2000 mm or more, and formation of a smooth flow (see Fr in FIG. 1) on the molten steel surface. That is, Test 4 was carried out to check a relationship between the intended discharge flow with linearity verified in Tests 1 to 3, and each of the elimination of stagnation of the molten steel flow and the formation of a smooth flow on the molten steel surface.

Test 4 was performed based on a water model. Operational conditions of a presupposed actual casting operation were as follows: the cross-section of the straight nozzle body=11.7 cm long side×4.3 cm short side (corners are rounded); the cross-sectional area (S2) of the inner hole of the straight nozzle body=50.3 $cm^2$; the total cross-sectional area (S1) of the outlet ports=64.5 $cm^2$; the ratio S1/S2=1.28; the angle of the axial direction of the outlet port=10° (laterally outwardly and downwardly relative to the horizontal direction); the immersion depth (the distance between the molten steel surface and the uppermost position of the outwardmost edge of the outlet port; see S5 in FIG. 19)=110 mm; and the configuration of the outlet port=a quadrangular columnar shape with a rectangular-shaped transverse vertical cross-section of 75 mm long side×43 mm short side (a height direction of the quadrangular columnar shape corresponds to the axial direction of the inner wall surface defining the outlet port).

In terms of the length of discharge portion, two types of inventive samples were prepared: one type had a minimum length of 45 mm; and the other type has a maximum length of 150 mm which was provisionally determined in view of practicality or reality, such as productability and cost performance, and a comparative sample (conventional immersion nozzle) having a length of 35 mm was prepared. Two molten-steel flow rates were set: one molten-steel supply amount=2.3 tons/min; and the other molten-steel supply amount=3.0 tons/min (0.036 tons/min·$cm^2$ and 0.047 tons/min·$cm^2$, per unit area of the outlet port, respectively). The thickness (i.e., short side) of the mold cavity is set at 150 mm.

Conditions of the water model test determined correspondingly to the above presupposed actual operational conditions were set as follows. As to an immersion nozzle, conditions were the same as those in the aforementioned full-sized wooden device. Widthwise and thicknesswise walls of a mold were made of an acrylic resin. Two water supply rates were set: one was 0.0046 tons/min·$cm^2$; and the other was 0.006 tons/min·$cm^2$.

Under the above conditions, a state of stagnation of a molten steel flow in the lateral end of the mold cavity was observed by measuring an upward flow (Fu in FIG. 19) at a position where a distance from a lateral end of the mold cavity in the water model is 20 mm (S1 in FIG. 19) and a depth (15 in FIG. 19) from the molten steel surface is 20 mm (S2 in FIG. 19), and a state of a smooth flow on the molten steel flow was observed by measuring a reversed flow (Fr in FIG. 19) directed from the lateral end of the mold cavity at a position where the distance from the lateral end of the water model is 500 mm (S4 in FIG. 19) and the depth (16 in FIG. 19) from the molten steel surface is 30 mm (S3 in FIG. 19), toward a lateral (i.e., widthwise) center of the mold cavity, while changing the width of mold cavity in the range of 1000 to 2500 mm. These measurements were also performed at opposite lateral ends of the mold cavity located in symmetrical relation to each other with respect to the lateral center of the mold cavity to observe a difference between respective molten steel flows on right and left sides of the immersion nozzle, i.e., turbulences or imbalance in the mold cavity.

The upward flow (Fu in FIG. 19) is an index for evaluating an effect on elimination of stagnation of a molten steel flow in an upper region of the lateral end of the mold cavity, and the revered flow (Fr in FIG. 19) is an index for evaluating a flow pattern in the entire mold cavity in connection with a change in flow pattern in the lateral end of the mold cavity. These flow patters are not fixed but changed depending on operational conditions of continuous casting, as one design factor of an immersion nozzle. In Test 4, the flow patterns were evaluated as adequate when the upward flow and the reversed flow is, respectively, in the range of 0.02 to 0.20 m/sec and in the range of 0.10 to 0.5 m/sec in a positive value, and a difference between right and left flow patterns is small.

Figure 20:
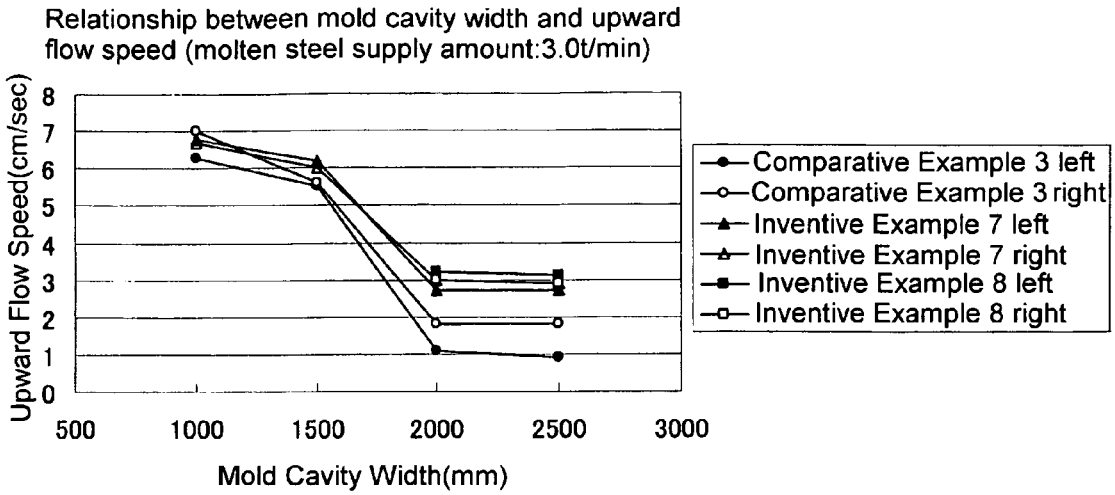
FIG. 20 is a graph showing a relationship between a mold cavity width and an upward flow speed in Test 4, wherein a molten-steel supply rate is set at 3.0 tons/min.
Figure 21:
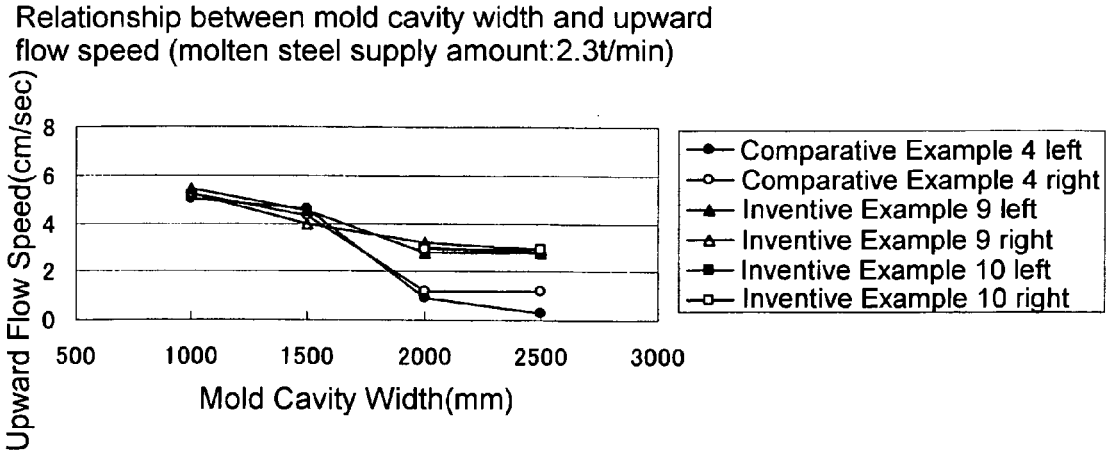
FIG. 21 is a graph showing a relationship between a mold cavity width and an upward flow speed in Test 4, wherein the molten-steel supply rate is set at 2.3 tons/min.
Figure 22:
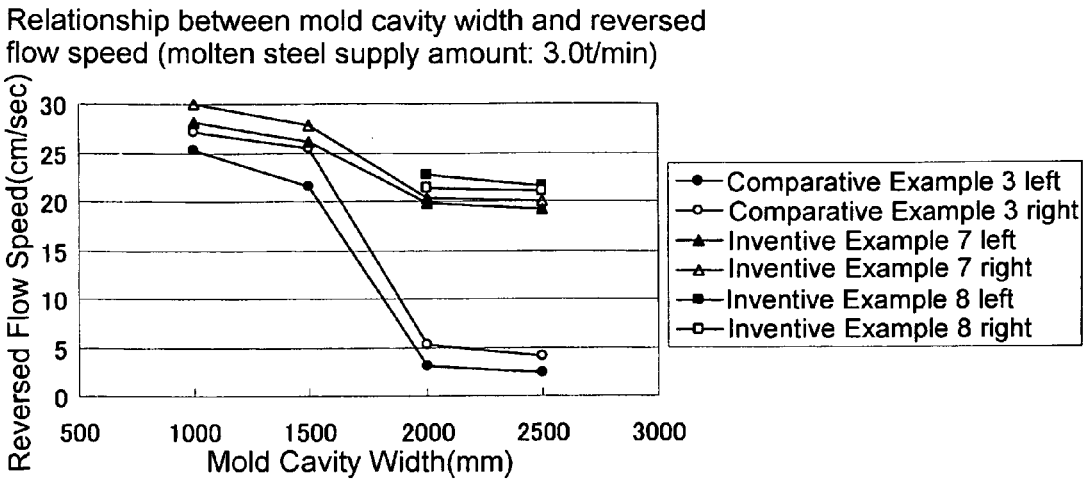
FIG. 22 is a graph showing a relationship between a mold cavity width and a reversed flow speed in Test 4, wherein the molten-steel supply rate is set at 3.0 tons/min.
Figure 23:
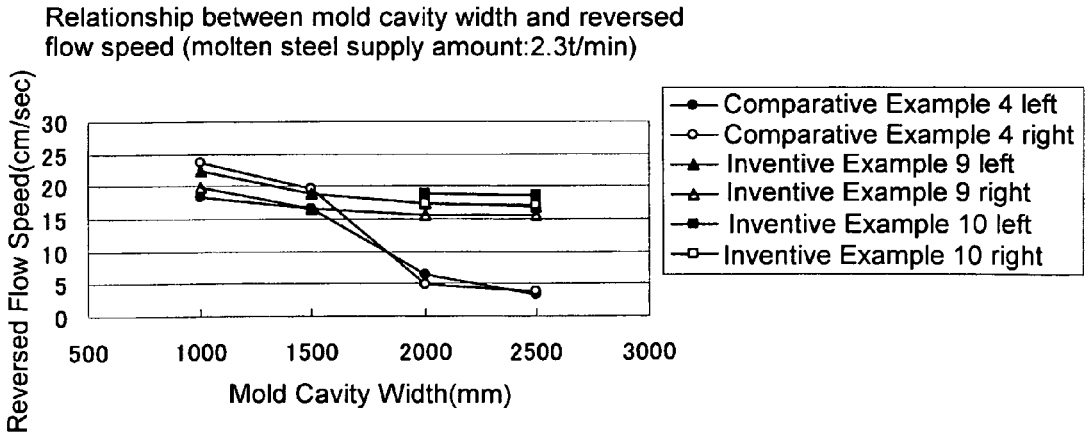
FIG. 23 is a graph showing a relationship between a mold cavity width and a reversed flow speed in Test 4, wherein the molten-steel supply rate is set at 2.3 tons/min.

Table 4 shows conditions, and measurement result of respective flow speeds of the upward flow and the reversed flow, in each sample. Further, FIGS. 20 and 21 are graphs showing measurement results about the upward flow, and FIGS. 22 and 23 are graphs showing measurement results about the reversed flow.

TABLE 4

| | | Comparative Example 3 | | | Inventive Example 7 | | | Inventive Example 8 | | |
|---|---|---|---|---|---|---|---|---|---|---|
| Length of discharge portion (mm) | | 35 | | | 45 | | | 150 | | |
| Molten-steel supply amount | t/min *1 | | | | 3.0 | | | | | |
| | t/min · $cm^2$ *2 | | | | 0.047 | | | | | |
| | Width of mold cavity (mm) | flow rate (cm/sec) | | lateral difference | flow rate (cm/sec) | | lateral difference | flow rate (cm/sec) | | lateral difference |
| | ↓ | left | right | (%) *3 | left | right | (%) *3 | left | right | (%) *3 |
| Upward flow × $10^{-2}$ (m/sec) | 1000 | 6.3 | 7.0 | 10.5 | 6.8 | 6.7 | 1.5 | | | |
| | 1500 | 5.5 | 5.6 | 1.8 | 6.2 | 6.0 | 3.6 | | | |
| | 2000 | 1.1 | 1.8 | 48.3 | 2.7 | 3.0 | 10.5 | 3.2 | 3.0 | 6.5 |
| | 2500 | 0.9 | 1.8 | 66.7 | 2.7 | 2.9 | 7.1 | 3.1 | 2.9 | 6.7 |

TABLE 4-continued

| | | | | | | | | | | |
|---|---|---|---|---|---|---|---|---|---|---|
| Reversed flow × $10^{-2}$ (m/sec) | 1000 | 25.2 | 27.1 | 7.3 | 28.2 | 30.0 | 6.2 | | | |
| | 1500 | 21.5 | 25.5 | 17.0 | 26.1 | 27.8 | 6.3 | | | |
| | 2000 | 3.0 | 5.3 | 55.4 | 19.8 | 20.4 | 3.0 | 22.7 | 21.3 | 6.4 |
| | 2500 | 2.4 | 4.1 | 52.3 | 19.2 | 20.0 | 4.1 | 21.6 | 21.1 | 2.3 |

| | | Comparative Example 4 | Inventive Example 9 | Inventive Example 10 |
|---|---|---|---|---|
| Length of discharge portion (mm) | | 35 | 45 | 150 |
| Molten-steel supply amount | t/min *1 | | 2.3 | |
| | t/min · $cm^2$ *2 | | 0.036 | |

| | Width of mold cavity (mm) ↓ | flow rate (cm/sec) left | flow rate (cm/sec) right | lateral difference (%) *3 | flow rate (cm/sec) left | flow rate (cm/sec) right | lateral difference (%) *3 | flow rate (cm/sec) left | flow rate (cm/sec) right | lateral difference (%) *3 |
|---|---|---|---|---|---|---|---|---|---|---|
| Upward flow × $10^{-2}$ (m/sec) | 1000 | 5.0 | 5.2 | 3.9 | 5.4 | 5.2 | 3.8 | | | |
| | 1500 | 4.6 | 4.3 | 6.7 | 4.5 | 4.0 | 11.8 | | | |
| | 2000 | 0.9 | 1.2 | 28.6 | 2.8 | 3.2 | 13.3 | 3.0 | 2.9 | 3.4 |
| | 2500 | 0.3 | 1.2 | 120.0 | 2.8 | 2.9 | 3.5 | 2.8 | 2.9 | 3.5 |
| Reversed flow × $10^{-2}$ (m/sec) | 1000 | 18.3 | 23.6 | 25.3 | 22.4 | 19.8 | 12.3 | | | |
| | 1500 | 16.6 | 19.7 | 17.1 | 18.7 | 16.5 | 12.5 | | | |
| | 2000 | 6.3 | 4.9 | 25.0 | 17.2 | 15.5 | 10.4 | 18.7 | 17.2 | 8.4 |
| | 2500 | 3.2 | 3.9 | 19.7 | 16.9 | 15.5 | 8.6 | 18.5 | 17.1 | 7.9 |

Figure 24:
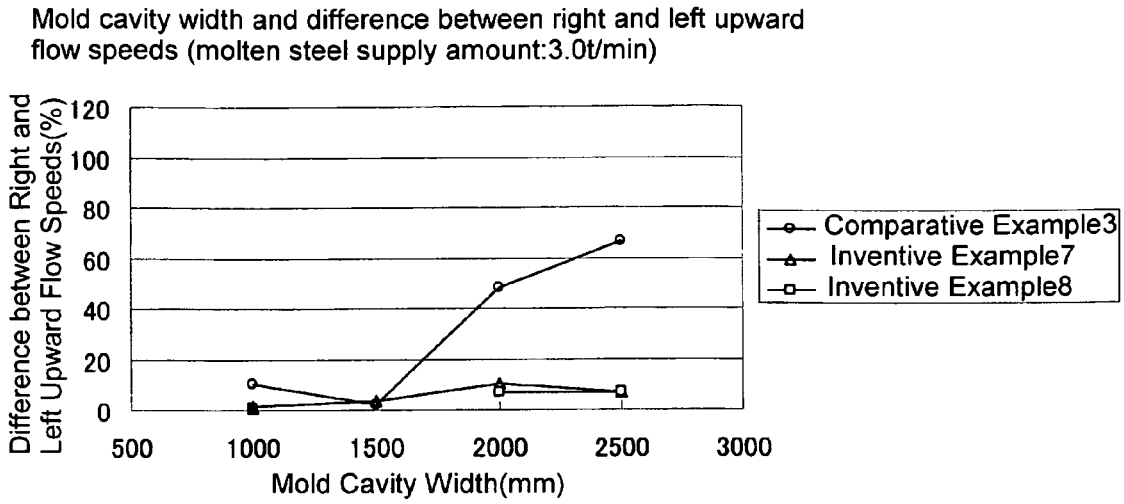
FIG. 24 is a graph showing a relationship between a mold cavity width and a difference between right and left upward flow speeds in Test 4, wherein the molten-steel supply rate is set at 3.0 tons/min.
Figure 25:
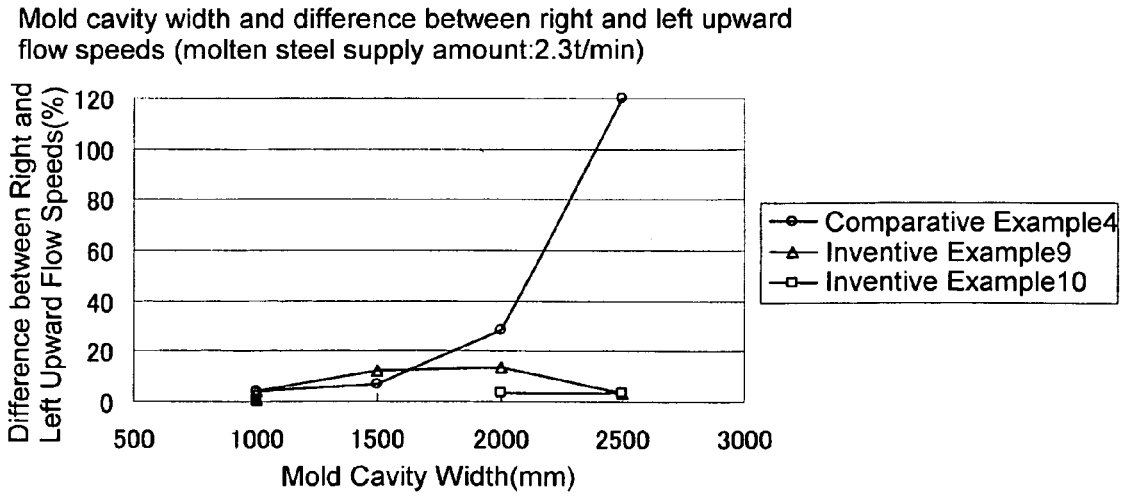
FIG. 25 is a graph showing a relationship between a mold cavity width and a difference between right and left upward flow speeds in Test 4, wherein the molten-steel supply rate is set at 2.3 tons/min.
Figure 26:
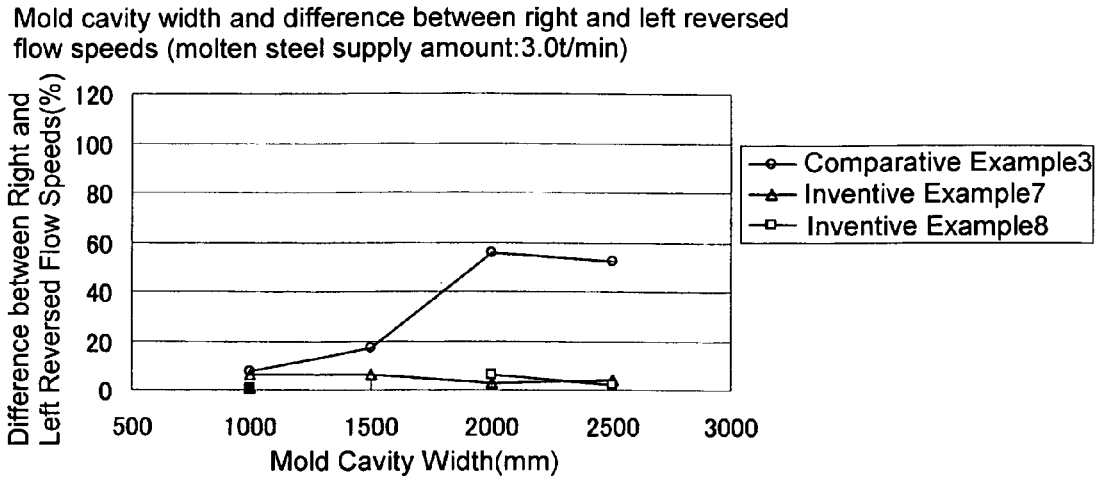
FIG. 26 is a graph showing a relationship between a mold cavity width and a difference between right and left reversed flow speeds in Test 4, wherein the molten-steel supply rate is set at 3.0 tons/min.
Figure 27:
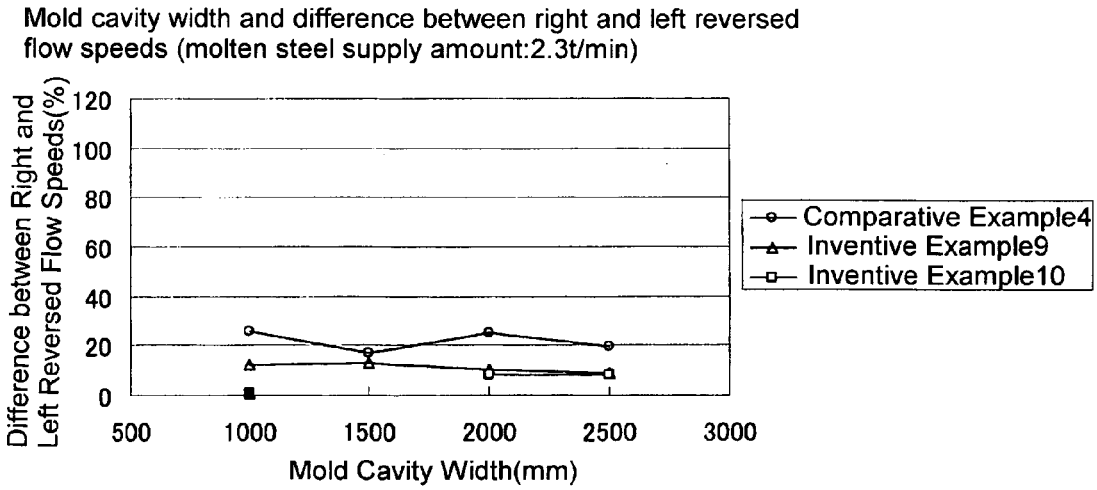
FIG. 27 is a graph showing a relationship between a mold cavity width and a difference between right and left reversed flow speeds in Test 4, wherein the molten-steel supply rate is set at 2.3 tons/min.

*1 total supply amount converted to molten steel
*2 supply amount per unit area of outlet port converted to molten steel
*3 ratio of difference between right and left flow speeds to average of right and left flow speeds Although cause and mechanism have not been clarified, as a result of Test 4, the upward flow speed is significantly reduced at a mold cavity width of about 2000 mm, and a level of reduction in the upward flow speed tends to become lower at a mold cavity width of greater than 2000 mm. Particularly, in Comparative Examples 3 and 4, the level of reduction in upward flow speed at a mold cavity width of 2000 mm is prominent. Differently, in all Inventive Examples, the level of reduction in the upward flow speed at a mold cavity width of 2000 mm or more is relatively low to maintain a stable upward flow speed. In Inventive Examples 9 and 10 having relatively small molten-steel supply amount, the level of reduction in the upward flow speed is lower than those in Inventive Examples 7 and 8 having a relatively large molten-steel supply amount. As to a difference between the right and left upward flow speeds (FIGS. 24 and 25), in each of Comparative Examples 3 and 4, the difference tends to be increased at a mold cavity width of 2000 mm or more, and a flow pattern in the entire cavity becomes unstable. Differently, in all Inventive Examples, the difference between the right and left upward flow speeds is small, and the flow pattern in the entire cavity is significantly stable.

A tendency similar to that of the upward flow speed is shown in the reversed flow speed. Specifically, an improvement effect of Inventive Examples on the reversed flow speed is greater than that on the upward flow speed. This shows that the effect of the present invention on the upward flow speed in the lateral end of the mold cavity facilitates enhancing an improvement effect on a flow pattern in the entire mold cavity.

As evidenced by the above test result, the immersion nozzle of the present invention can improve a molten steel flow in a mold cavity, particularly, in a wide mold cavity having a width of 2000 mm or more. In addition, the immersion nozzle of the present invention can significantly suppress a difference between molten steel flows on right and left sides of the immersion nozzle to obtain a stable flow pattern in the entire mold cavity.

Test 5

Test 5 was carried out to verify a throughput range capable of optimally providing the effects of the present invention, through a computer-based fluid flow analysis.

This verification was performed using a CFD software (FLUENT produced by FLUENT Inc.). Operational conditions of a presupposed actual casting operation, i.e., input data for calculations were as follows.

Conditions of the immersion nozzle and the immersion depth were the same as those in Test 4, and the width and thickness of the mold cavity were set at 2500 mm and 150 mm, respectively. The molten-steel flow rate was set at a molten-steel supply amount of 1.5 to 4.5 tons/min (0.023 to 0.071 tons/min·$cm^2$ per unit area of the outlet port). The length of the discharge portion was set at a minimum length of 45 mm in the range as defined by the present invention.

Figure 28:
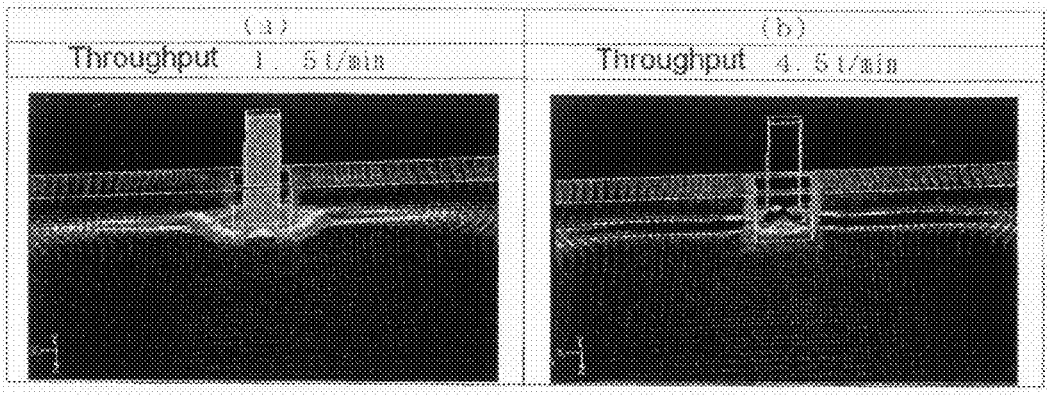
FIGS. 28(*a*) and 28(*b*) illustrate examples of an analytical result of a flow in the mold cavity, wherein FIG. 28(*a*) shows an analytical result under a condition that a throughput is less than 1.8 tons/min, and FIG. 28(*b*) shows an analytical result under a condition that the throughput is greater than 4.5 tons/min.

Table 5 shows a result of Test 5, and FIGS. 28(*a*) and 28(*b*) illustrate a flow pattern in the mold cavity, wherein the throughput is set at 1.5 tons/min and 4.5 tons/min, respectively.

TABLE 5

| | Inventive Example 11 | Inventive Example 12 | Inventive Example 13 | Inventive Example 14 | Inventive Example 15 | Inventive Example 16 | Inventive Example 17 | Inventive Example 18 | Inventive Example 19 |
|---|---|---|---|---|---|---|---|---|---|
| Molten-steel supply amount t/min | 1.5 | 1.8 | 2.0 | 2.5 | 3.0 | 3.5 | 4.0 | 4.5 | 5.0 |
| Length of discharge portion (mm) | | | | | 45 | | | | |
| Upward flow × $10^{-2}$ (m/sec) | <0.1 | 2.5 | 2.7 | 2.9 | 2.8 | 2.9 | 3.0 | 2.9 | 3.1 |
| Reversed flow × $10^{-2}$ (m/sec) | <1 | 15 | 16 | 17 | 18 | 19 | 20 | 20 | 50< |

When the throughput was set at a value of less than 1.8 tons/min, the upward flow and the reversed flow could not be adequately obtained. Further, when the throughput was set at a value of greater than 4.5 tons/min, the reversed flow was excessively formed to increase the risk of occurrence of turbulences around the immersion nozzle. This result shows that the immersion nozzle of the present invention can sufficiently provide the intended effects when the throughput is in the range of 1.8 to 4.5 tons/min.

Test 6

Test 6 was carried out to verify the effects of the present invention checked by the water model test in TEST 4, based on visualization of a flow pattern of a molten steel flow just after being discharged from the outlet port of the immersion nozzle, through a computer-based fluid flow analysis.

This verification was performed using a CFD software (FLUENT produced by FLUENT Inc.). Operational conditions of a presupposed actual casting operation, i.e., input data for calculations were as follows.

Conditions of the immersion nozzle and the immersion depth were the same as those in Test 4, and the width and thickness of the mold cavity were set at 2500 mm and 150 mm, respectively. The molten-steel flow rate was set at a molten-steel supply amount of 2.7 tons/min (0.042 tons/min·$cm^2$ per unit area of the outlet port). The length of the discharge portion was set at a minimum length of 45 mm in the range as defined by the present invention. For comparison, Comparative Example (conventional immersion nozzle) having a discharge portion with a length of 35 mm was prepared.

Figure 29:
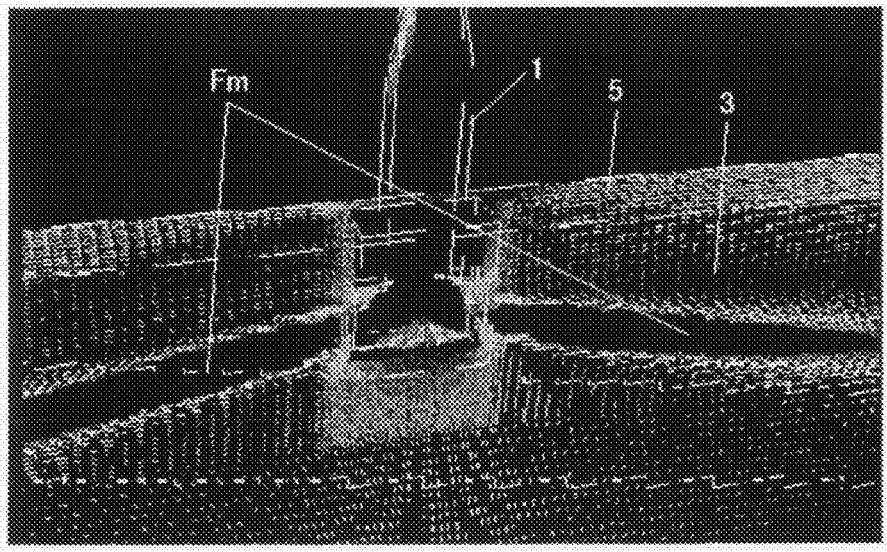
FIG. 29 illustrates a flow pattern based on an immersion nozzle according to the present invention, in Test 6.
Figure 30:
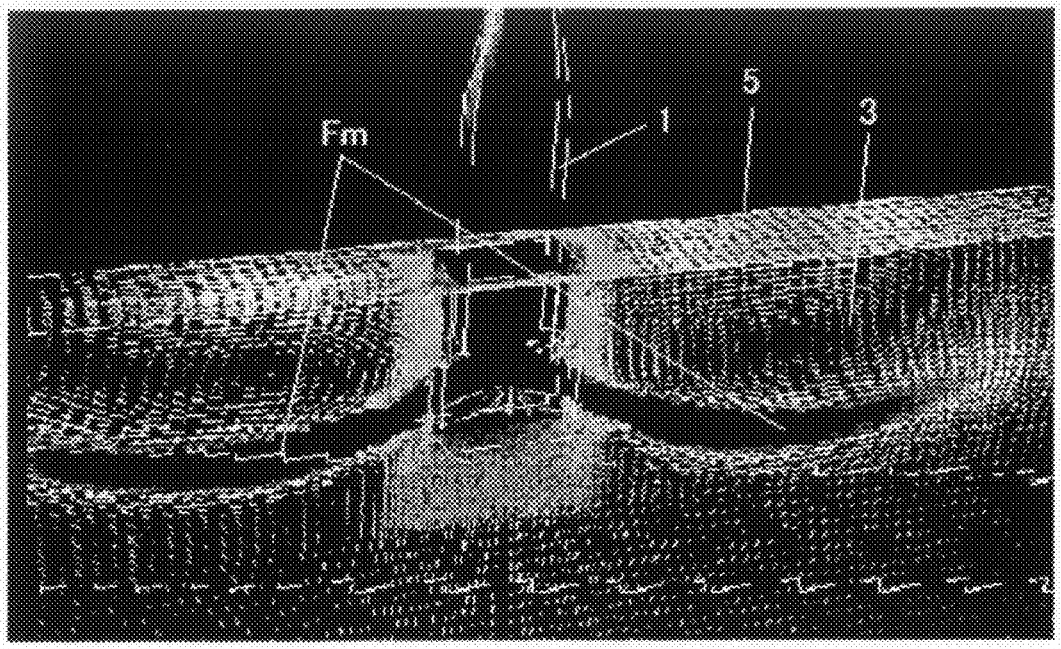
FIG. 30 illustrates a flow pattern based on a conventional immersion nozzle, in Test 6.
Figure 31:
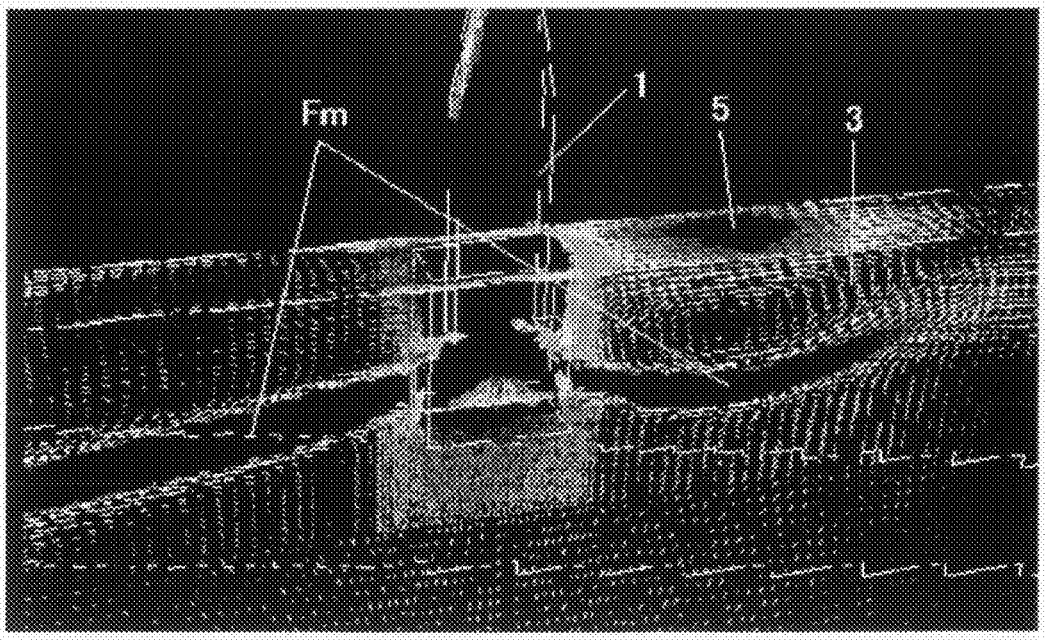
FIG. 31 illustrates a flow pattern based on a conventional immersion nozzle, in Test 6, wherein a relatively large difference between right and left flows occurs.

FIG. 29 shows a flow pattern of Inventive Example, and FIGS. 30 and 31 show flow patterns of Comparative Example, wherein these flow patterns were visualized in a width range of about 1000 mm, specifically in a width range of about 500 mm located on each of right and left sides of the immersion nozzle.

As evidenced by the verification result, in Inventive Example, a molten steel flow is linearly discharged along a preset axial direction of the outlet port substantially without spreading and deceleration. In addition, a difference between molten steel flows on right and left sides of the immersion nozzle is significantly small, and the molten steel surface (see 5 in FIG. 29) is maintained in an even and smooth flow pattern without turbulences. It is also proven that this linear flow with an adequately maintained flow speed allows excellent flow pattern to be formed over a wide range which reaches the lateral end of the wide mold cavity.

In contrast, in Comparative Example, a molten steel flow starts largely decelerating just after being discharged from the outlet port of the immersion nozzle. Moreover, in conjunction with the deceleration, the molten steel flow is spread. Consequently, a distal end of the molten steel flow is formed as an upward flow in a vicinity of the immersion nozzle, and a flow directed toward the immersion nozzle along the molten steel surface (see 5 in FIG. 30) is accelerated to cause a strong downward flow in a region in contact with the immersion nozzle (see FIG. 30).

Moreover, in Comparative Example, right and left flow patterns are significantly changed to cause imbalance and instability in flow pattern (see FIG. 31). Particularly, as seen in FIG. 31, a flow pattern with serious spreading and upward flows frequently occurs just after molten steel is discharged from the immersion nozzle.

The above flow pattern in Comparative Example precludes formation of a desirable molten steel flow over a wide range including the lateral end of the wide mold cavity, and increases the risk of formation of an undesirable flow moving a mold powder and non-metal inclusions downwardly from the molten steel surface, in a local region of the mold cavity. Furthermore, the molten steel flow speed will become significantly low in the vicinity of the lateral end of the mold cavity to cause adverse effects, such as occurrence of stagnation of molten steel and a reduction in temperature of molten steel, or difficulty in smoothly supplying a mold powder onto a surface of a slab and in allowing non-metallic inclusion to float up (to be eliminated).

EXPLANATION OF CODES

1: immersion nozzle
2: mold
3: molten steel
4: shell
5: molten steel surface
7: stagnation of molten steel flow (image)
8: stagnation of molten steel flow (image)
9: inlet port
10: straight nozzle body
11: inner hole of straight nozzle body
12: outlet port
13: intersecting point between an inner hole surface of straight nozzle body and an inwardmost edge of inner wall surface defining a space of outlet port
14: point of an outwardmost edge of inner wall surface defining a space of outlet port
15: measuring point of upward flow in the test 4
16: measuring point of reversed flow in the test 4
Mw: width of mold cavity
Mt: thickness of mold cavity Fm: molten steel flows discharged from outlet ports (image)
Fr: reversed flow (image)
Fu: upward flow (image)
L1: length of discharge portion
Ds: axial direction of straight nozzle body
Dt: axial direction of outlet port
Dm: discharge direction of molten steel
S1: distance between said point 15 and lateral end of mold
S2: depth of said point 15 from molten steel surface
S3: depth of said point 16 from molten steel surface
S4: distance between said point 16 and lateral end of mold
S5: immersion depth
θt: angle of outlet port (axial) direction
Δθ: angular difference

What is claimed is:

1. An immersion nozzle, comprising:

a pipe-shaped straight nozzle body which is formed to extend in a substantially vertical direction and have an inlet port at an upper end thereof, and adapted to allow molten steel to pass downwardly from said inlet port therethrough; and a pair of discharge portions each including a respective one of a pair of outlet ports which are provided in a lower portion of said straight nozzle body bilaterally symmetrically with respect to said straight nozzle body, and adapted to discharge molten steel from a lateral side of said straight nozzle body therethrough in laterally opposite directions, each of said outlet ports being defined by an inner wall surface formed in a corresponding one of said discharge portions, said pair of discharge portions being structurally configured such that said molten steel, when passed downwardly from said inlet port, is exclusively dischargeable through said pair of outlet ports, wherein:

said inner wall surface defining said outlet port in each of said discharge portion is formed to extend parallel to a longitudinal direction of an axis of said outlet port in such a manner as to define a length of said discharge portion at 45 mm or more;

a ratio of S1/S2 is in the range of 0.8 to 1.8, wherein S1 is a total transverse vertical cross-sectional area of said outlet ports, and S2 is a cross-sectional area of an inner hole of said straight nozzle body taken along a plane which includes a line connecting respective uppermost positions of inwardmost edges of said outlet ports and extends in perpendicular relation to an axial direction of said straight nozzle body; and said axis of each of said outlet ports extends laterally outwardly and downwardly at an angle θt falling within the following range with respect to a horizontal direction: $0° \leqq \theta t \leqq 20°$.

2. A method of continuous casting, comprising:

providing a mold having a mold cavity formed with a substantially rectangular-shaped horizontal cross-section having a long side of 2000 mm or more and a short side of 150 mm or less; and pouring molten steel into said mold cavity of said mold at a throughput range of 1.8 to 4.5 tons/min using the immersion nozzle of claim 1.

3. The immersion nozzle according to claim 1, in combination with a mold having a mold cavity formed with a substantially rectangular-shaped horizontal cross-section having a long side of 2000 mm or more and a short side of 150 mm or less, said immersion nozzle being configured to be capable of pouring molten steel at a throughput range of 1.8 to 4.5 tons/min.

* * * * *